US006042063A

United States Patent [19]

Kerr et al.

[11] Patent Number: 6,042,063

[45] Date of Patent: Mar. 28, 2000

[54] T-SHIRT BAG RACK WITH CANTILEVERED BAG SUPPORT ARMS AND METHOD

[75] Inventors: Jonathan F. Kerr, Paradise Valley, Ariz.; Peter D. Dieterich, Jr., Mill Valley, Calif.; Roy K. Fischer, Scottsdale, Ariz.

[73] Assignee: Handle Helper, L.P., San Francisco, Calif.

[21] Appl. No.: 09/226,999

[22] Filed: Jan. 7, 1999

Related U.S. Application Data

[63] Continuation-in-part of application No. 09/010,890, Jan. 22, 1998.

[51] Int. Cl.[7] ..... B65B 67/04; A63B 55/04

[52] U.S. Cl. ..... 248/100; 248/97

[58] Field of Search ..... 248/100, 95, 97, 248/99, 101; 220/495.11, 407, 410; 383/8; 206/284, 288, 622, 626, 634

[56] References Cited

U.S. PATENT DOCUMENTS

| | | | |
|---|---|---|---|
| 447,686 | 3/1891 | Holladay . | |
| 688,238 | 12/1901 | Davis | 248/97 |
| 3,552,697 | 1/1971 | Pinto | 248/97 |
| 4,199,122 | 4/1980 | Christie | 248/97 |
| 4,366,916 | 1/1983 | Guido et al. | 248/99 X |
| 4,407,474 | 10/1983 | Swenson | 248/97 |
| 4,437,634 | 3/1984 | Hambleton | 248/97 |
| 4,458,867 | 7/1984 | Malik | 248/97 |
| 4,723,743 | 2/1988 | Jenkins | 248/97 |
| 4,750,694 | 6/1988 | Bateman | 248/97 |
| 4,821,985 | 4/1989 | DeMatteis et al. | 248/97 |
| 4,840,335 | 6/1989 | Forman, Jr. et al. | 248/97 |
| 4,840,336 | 6/1989 | Stroh et al. | 248/97 |
| 5,029,926 | 7/1991 | Dieterich, Jr. | 294/171 |
| 5,058,767 | 10/1991 | Dieterich, Jr. | 221/279 |
| 5,190,253 | 3/1993 | Sable | 248/99 X |
| 5,213,145 | 5/1993 | Huang et al. | 141/391 |
| 5,667,173 | 9/1997 | Wilfong, Jr. et al. | 248/100 |
| 5,785,205 | 7/1998 | Kerr et al. | 221/26 |

FOREIGN PATENT DOCUMENTS

| | | | |
|---|---|---|---|
| 399781 | 7/1909 | France | 248/97 |

*Primary Examiner*—Ramon O. Ramirez
*Assistant Examiner*—Michael Nornberg
*Attorney, Agent, or Firm*—Flehr Hohbach Test Albritton & Herbert LLP

[57] ABSTRACT

A bag rack (10, 110, 210) including a base (12, 112), side walls (18, 20, 114, 116), a back wall (22, 118) and a pair of L-shaped bag support arms (32, 160, 162). Side walls (18, 20, 114, 116) are releasably joined and secured to back wall (22, 118) by the upright legs (30, 146) of bag support arms (32, 160, 162) by means of a series of interlocking, aligned slots (26, 28, 142, 144). A rear slot (42, 172) is provided between back wall (22, 118) and base (12, 112) to allow the bottom edges of a multiplicity of bags carried by a hook (37, 156) to extend back of base (12, 112). An embodiment of the back rack (110) is shown in which the bag supporting arms (160, 162) are coupled together by a transversely extending rear extension (164), which cooperatively engages a structure, preferably pairs of channels (168, 170), on the back wall (118) of the bag rack (110) to secure the bag supporting arms (160, 162) in a desired vertical height and to transfer cantilever loading of the bag supporting arms (160, 162) to the back wall (118).

12 Claims, 16 Drawing Sheets

T-SHIRT BAG RACK WITH CANTILEVERED BAG SUPPORT ARMS AND METHOD

RELATED APPLICATION

This is a continuation-in-part application of previously filed application Ser. No. 09/010,890, filed Jan. 22, 1998, entitled "Plastic Bag Rack."

TECHNICAL FIELD

This invention relates to bag racks for dispensing and packing of plastic bags, particularly of the T-shirt type and, more particularly, to an improved vertically adjustable bag support arm design and a method for loading items into a T-shirt bag using a bag rack.

BACKGROUND ART

Plastic T-shirt bags have largely displaced paper bags over the last twelve years in grocery and other major retail markets. One of the major reasons for the market success of plastic bags, aside from their inherent cost advantage, has been the development of racks to manage the thin, flexible and difficult to control bags. Unlike a paper bag that can stand up on its own while being loaded with groceries, plastic bags initially required a packer to hold the bag up in an open position with one hand and load the groceries with the other hand.

The primary function of early plastic bag racks was to hold the bags suspended over a base in an open position, freeing the packer to use both hands to load the groceries. Following these early racks were numerous bag rack designs that improved the speed with which the bags could be opened, packed and removed. Bag racks were developed that could store and accommodate a flat bundle of unopened bags. Opening of the bags was made easier by perforating both arms of each bag handle and suspending the bags from these perforations by cantilevered arms on each side of the rack. The entire bundle of bags could be pre-loaded onto the cantilevered arms and held in place by hooking the bags to the back of the rack. Opening a bag involved simply pulling the front of the bag forward, as the handles slid along the cantilevered arms. Opening of the bags was made easier still by forming a thin film tab at the top center of the bag which enabled the packer to pull the front of the bag forward and open the bag by merely grasping and pulling forward on the tab. Further developments led to connection of a succession of the bags at this tab section so that the removal of the first bag from the rack pulled the tab of the next bag, semi-automating the bag-opening process.

For all their advantages and speed in opening bags, however, plastic bag racks still do little more to improve actual packing of the bag than to suspend the bag in an open position. The thin plastic film bags have no inherent structure for supporting items loaded therein. When loaded improperly or in a random fashion, the bags stand up properly and contain the grocery items only for as long as they are suspended from the rack. When they are removed and placed on the counter or in a shopping cart, the sides are no longer supported and, as a result, they slump down as the groceries shift and lean against the thin sides of the bag that offer no support. To prevent this, store personnel typically under-fill the bags to avoid spilled groceries. Lower item counts per bag lead to higher bagging costs and also waste material.

Plastic bags can be packed to the same capacity as a similarly dimensioned paper bag, and still remain stable in transit, but the items must be carefully placed in the bag. The most important step in packing a plastic bag so that it will be stable when filled to the bag's capacity is the placement of the very first items. These items, which are ideally boxes and other wide items, should be placed up against the interior sides and front and back of the bag to "build the perimeter." Then the base or bottom of the bag can be packed with stable or heavy items such as a beverage six-pack, and smaller, lighter items can then be placed on top in the center.

Such a proper packing procedure requires considerable care because the thin, flexible sides of the bag provide no support for the initial items around the bag's perimeter. Items pushed out to the sides of the bag walls will either slip right off the edge of the rack base or not stand up because there is nothing for them to lean against. If the first item does stand up on its own, pushing the next item up against the opposite side of the bag can topple the first item by the next item pulling the bag in the opposite direction.

Packers can be observed compensating for this tendency of the plastic bags by leaving one hand inside the bag to prevent the first items from falling inward and holding space open in the center of the bag, while reaching for and retrieving the next items with the other hand. Packing with one hand not only slows the bagging process, repetitive leaning and reaching can introduce ergonomic hazards as well. Again, plastic bag racks have made very little real progress in addressing the difficulty inherent in packing thin, flexible, difficult to control bags.

Plastic bags can be packed correctly, but the bagger must use care and learn the physical boundaries or limits of both the bag and base of the rack being used by that particular store. Such careful packing of the bags is seldom accomplished. The situation is exacerbated by the youth and high rates of turnover among store employees hired to pack bags. The demands placed on baggers to get customers through the checkout line result in poorly packed, and therefore under-filled bags. Retailers complain about the under filling of plastic bags and the associated costs, and the plastic bag manufactures respond by generating training materials to counteract improper and under filled bags. The stores are sent well-produced printed materials and videotapes to educate store employees on the proper bagging procedure. The success of these campaigns then depends on busy store managers who must schedule, implement and continually reinforce the training program as new baggers are hired. If these training efforts are begun at all, they are typically abandoned in short order due to the sheer volume of people who go through these positions.

The first racks built to suspend plastic bags in an open position were of sheet metal construction. These sheet metal racks had sharp edges and required manual opening of the bag and hooking the loops over pegs or other loop-holding designs. The sheet metal racks were also awkward to unload as the loops of a full bag had to be unhooked from the pegs. Another disadvantage of the sheet metal racks was their tall parallel sides. When a bagger over-filled a bag, the bag would be difficult to remove due to the friction against the opposed side walls. The sheet metal racks were eventually replaced by racks constructed of formed wire with a solid base of sheet metal or a thick thermoplastic.

The first formed wire racks required manual opening of the bag but did not have the sharp edges of sheetmetal racks and provided the strength and durability necessary for continually used dispensing apparatus. A subsequent generation of racks, which are in predominant use today, are also of the formed wire variety and incorporate cantilevered arms to facilitate easy-opening bags. These wire racks, like their predecessors provided strength but required numerous secondary operations to construct.

Each wire rack has many separate sections of wire which must be bent into shape, then cut to length, crimped, welded together, ground at the ends and sometimes the welds, chrome plated, and assembled with a base that also has been cut, drilled, etc. The number of secondary manufacturing operations required to construct these racks have made them costly to produce.

Plastic bag companies are typically forced to provide their racks free of charge to their larger customers. Adding to their cost is the fact that they are cube-shaped with parallel sides which makes nesting impossible and can therefore only be shipped and stored two in a box. A typical store will have eight or more checkouts with two or three bag racks per checkout. Thus, cost is a paramount concern.

Yet another disadvantage of the current formed and welded wire racks is the proliferation of alternative plastic bag sizes in recent years. The initial plastic bags were predominantly the same size as their paper counterparts: ⅙th barrel bags. Many retailers, however, concluded that if their plastic bags were being under-filled anyway, why not use a somewhat smaller, less expensive bag: the ⅐th barrel bag. Still other retailers reasoned that a thicker, larger bag would encourage baggers to fill the bags. This led plastic bag manufacturers to introduce the larger, heavy-gauge "big bag." For a bag rack to function properly, it must suspend the bag so that when the bag is fully opened, the gusseted bottom of the bag rests flat on the base of the rack. The proliferation of bag sizes therefore led to a proliferation of rack sizes. Once a wire rack was formed and welded as a unit, it was dedicated to particular bag size. The bag manufactures were thus forced to stock a multitude of finished bag racks and to replace and discard the expensive racks every time a customer switched to a different bag size.

The current bag racks suffer from other deficiencies as well. Many of the bag racks are mounted to the side of the checkout counter rather than placed on top of the counter in order to conserve space for the flow of groceries as an order is processed. Although some racks have been fashioned with height adjustments, most racks are mounted at a fixed height by their backs in perpendicular orientation to the counter. Some are mounted to the counter by the side of the rack. Either way, once mounted, the racks are inevitably too low for some individuals and too high for others. Further, unlike the bag racks placed on top of the counter, the current bag racks are designed to be mounted in way that allows for no adjustment to the angle that is optimum for a particular individual for retrieving and packing groceries from a particular check stand configuration, which vary greatly in design and configuration.

Even if the rack were specifically made for mounting to a particular check stand, the current designs allow no minor adjustments during the course of a workday. When people are required to perform repetitive motions for long periods of time, it is preferable that they are given the ability to make their own adjustments to their workspace, particularly when numerous individuals utilize the same work space.

DISCLOSURE OF INVENTION

Briefly described, the bag rack of the present invention includes a rear extension secured to the bag support arms and extending behind a back wall of the bag rack. The back wall includes a channel for coupling to the rear extension so that a downward force on the forwardly extending bag support arms biases the rear extension into the channel and ensures that the bag support arms remain secured to the back wall. Preferably, the channel is open to the rear of the back wall to allow passage of the rear extension into the channel. In other words, the rear extension is not limited by the channel and can be easily removed in order to reposition the cantilevered arms of the bag rack in a different vertical position.

According to an aspect of the invention, the rear extension is provided by a cross bar that extends transversely between the pair of bag support arms and across the back side of the back wall of the rack. The cross bar extends the width of the bag rack and provides bracing for the cantilevered arms against the back wall. The channel on the back wall faces rearwardly so that downward forces on the forwardly extending bag support arms biases the cross arm forwardly into the channel. Preferably, the back wall is bowed so that the bracing of the rear cross bar transfers forces from the bag support arms to the side walls of the bag rack, where the structural support provided by the side walls counteracts and supports the back wall and counteracts the loading forces on the cantilevered arms.

According to another aspect of the invention, the bag support arms are vertically adjustable and the back wall includes at least a second channel vertically displaced from the first channel. With a second channel, the bag support arms are positionable in at least two vertical locations relative to the base and the rear extension can be coupled to one of the first and second channels at each vertical location.

The present invention also includes a method of loading items into a T-shirt style bag supported by a bag rack and includes the steps of supporting a T-shirt style bag in a suspended position from a pair of cantilevered bag support arms over a base that provides support to the bottom of the bag, supporting the sides and back of the bag with substantially imperforate walls that limit deformation of the bag beyond the base of the bag rack, loading the bag as so supported, removing a loaded bag from the cantilevered arms by sliding the bag forwardly from the bag rack and out the open front of the bag rack.

According to an aspect of the method, a further step includes supporting the sides of the bottom of the bag with upwardly turned side edges of the base. According to another aspect of the invention, the method includes the step of reorienting the bag rack by mounting the bag rack in a suspended position that allows the bag rack to be repositioned both vertically and angularly.

According to yet another aspect of the invention, an additional step includes repositioning the cantilevered arms relative to the base in order to accommodate different size bags.

The present invention also comprises an adjustable bag rack that can be altered and adjusted to accommodate various accessory items and which can be tailored to different customer needs. This aspect of the present invention comprises a bag rack for support of plastic T-shirt bags with attachment mounts on the side walls of the bag rack for securing to the bag rack different attachments for use with bagging items in bags supported on the bag rack. The bag rack also includes a pair of spaced-apart, vertically adjustable bag support arms each extending forwardly, cantilevered outwardly over the base, to position the bag support arms for support of at least two different size T-shirt bags, each in a distended condition over the base for filling of the bag. With this embodiment, the bag rack can accommodate various accessory items and can be adjusted as well to carry different size T-shirt style bags for loading with items.

According to an aspect of this embodiment of the invention, the attachment mounts are adapted to support smaller bags used to individually bag certain items within a larger T-shirt bag supported on the bag rack, or a bag handle dispenser.

According to another aspect of this embodiment of the invention, a support is provided for securing to the back wall, for supporting printed material for display from the back of the bag rack.

A principle advantage of the bag rack dispenser of the present invention is its flexibility to accommodate different size bags as well as different accessories through adjustment and modification of the various features of the bag rack discussed herein. The bag rack dispenser can be raised and lowered to accommodate different size bags, side bag holders and additional bag stacks can be attached to either side of the bag rack, and different advertising displays can be mounted at the rear of the bag rack. And these features can be mixed and matched to suit a particular customers preferences. As a result of this flexibility, stores can significantly reduce the number of different types of bag racks they stock.

These and other features, objects, and advantages of the present invention will become apparent from the following description of the best mode for carrying out the invention, when read in conjunction with the accompanying drawings, and the claims, which are all incorporated herein as part of the disclosure of the invention.

BRIEF DESCRIPTION OF THE DRAWINGS

Throughout the several views, like reference numerals refer to like parts, wherein.

BEST MODE OF CARRYING OUT THE INVENTION

Reference will now be made in detail to the preferred embodiments of the invention, examples of which are illustrated in the accompanying drawings. While the invention will be described in conjunction with the preferred embodiments, it will be understood that the described embodiments are not intended to limit the invention specifically to those embodiments. On the contrary, the invention is intended to cover alternatives, modifications and equivalents, which may be included within the spirit and scope of the invention as defined by the appended claims.

Figure 1:
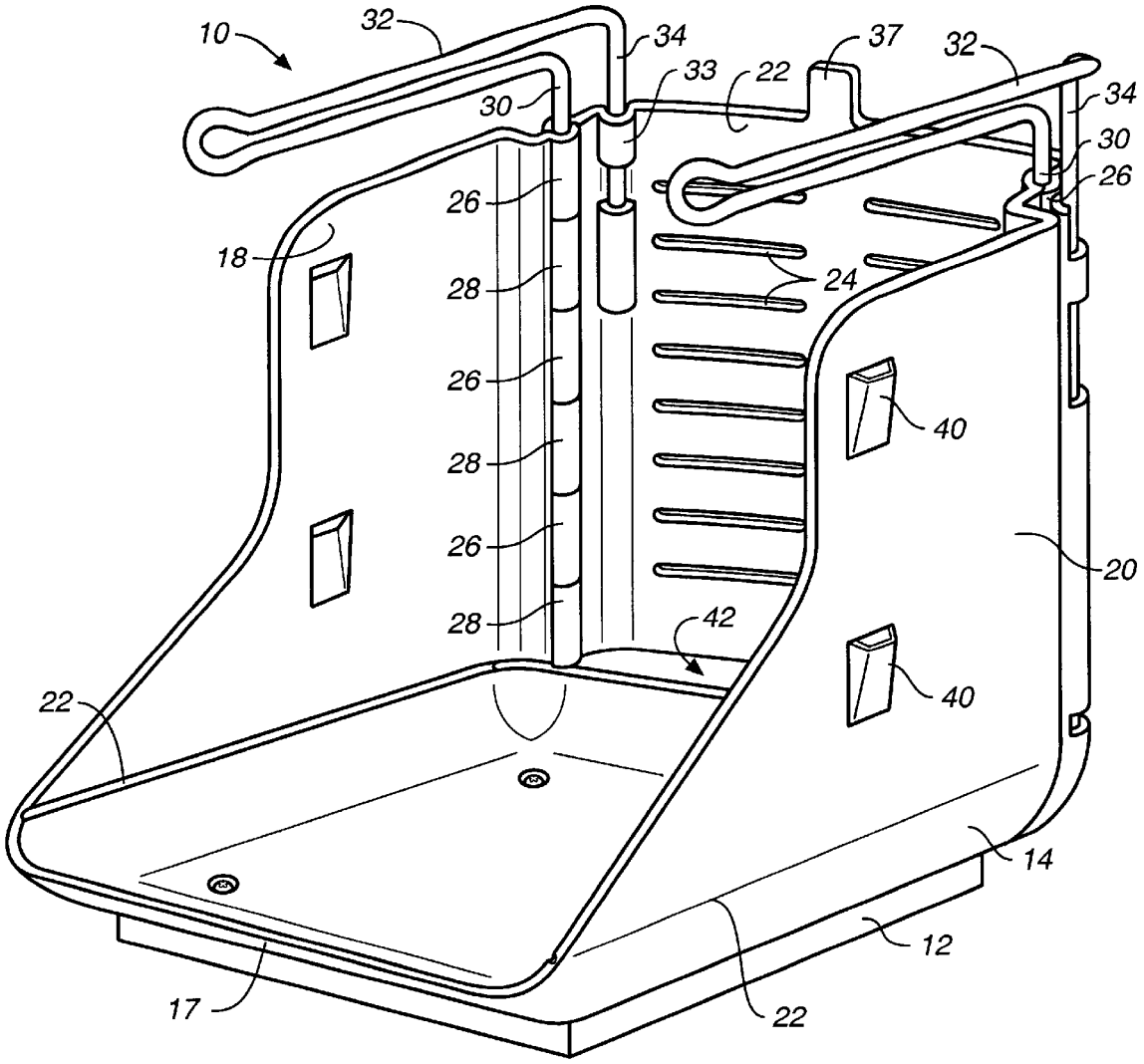
FIG. 1. pictorial view of a first embodiment of a T-shirt bag rack dispenser of the present invention.

Referring to FIG. 1, a first embodiment of the bag rack 10 of the present invention includes a rectangular base 12 having upwardly turned side edges 14, an upwardly turned back edge 16, and an upwardly turned front edge 17 that is formed lower than side edges 14.

Figure 5:
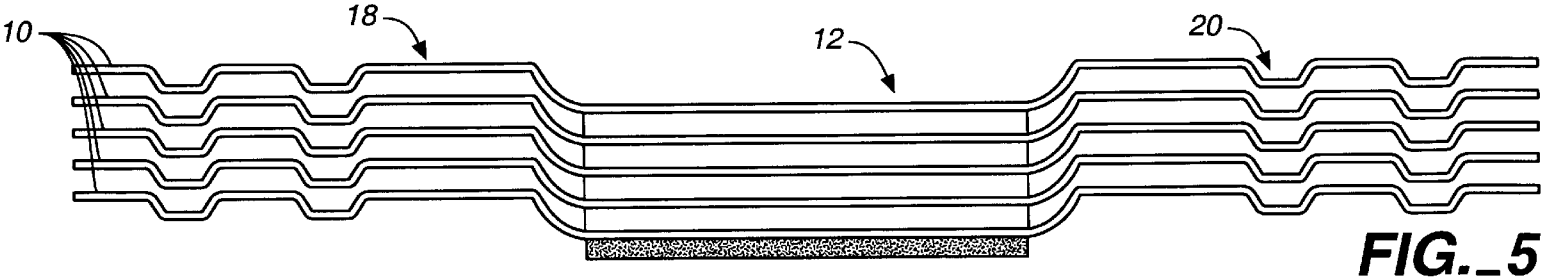
FIG. 5 is cross-sectional view of several bag racks in an unfolded, stacked configuration, each bag rack shown as taken along the line 7—7 of FIG. 3.

Bag rack 10 includes a pair of left and right side walls 18, 20 and a detachable back wall 22. Preferably, side walls 18, 20 are formed monolithically with base 12, with thin wall hinges 22 formed at the upper edges of side edges 14, which allow side walls 18, 20 to fold from an upward position, as shown in FIG. 1, to a substantially flat orientation for stacking, as shown in FIG. 5.

Forming side walls 18, 20 monolithically with base 12 in a substantially flat orientation and separately forming the substantially flat back wall 22, rather than forming these elements together in a cubic configuration, also simplifies the manufacturing process and obviates the need for costly injection molding slides.

Side walls 18, 20 are formed so that they are not precisely parallel with each other, but rather diverge outwardly so that the space between them is slightly greater at the front of base 12, opposite back wall 22. This ensures that a plastic bag that is overstuffed with items in a manner where the items press against the side walls, can slide outwardly as the bag is released and removed from the bag rack.

Detachable back wall 22 includes a series of slots 24 which are used for mounting the back wall to a fixed support structure at a check-out counter. Slots 24 allow for the rotation of bag rack 10 about its support to enhance the ergonomics of the T-shirt bagging procedure for different store personnel and checkout counter configurations. For example, left-handed and right-handed baggers may wish to have the bag rack oriented at slightly different angles to simplify bagging. Slots 24 are discussed in more detail with reference to FIG. 6.

Figure 2:
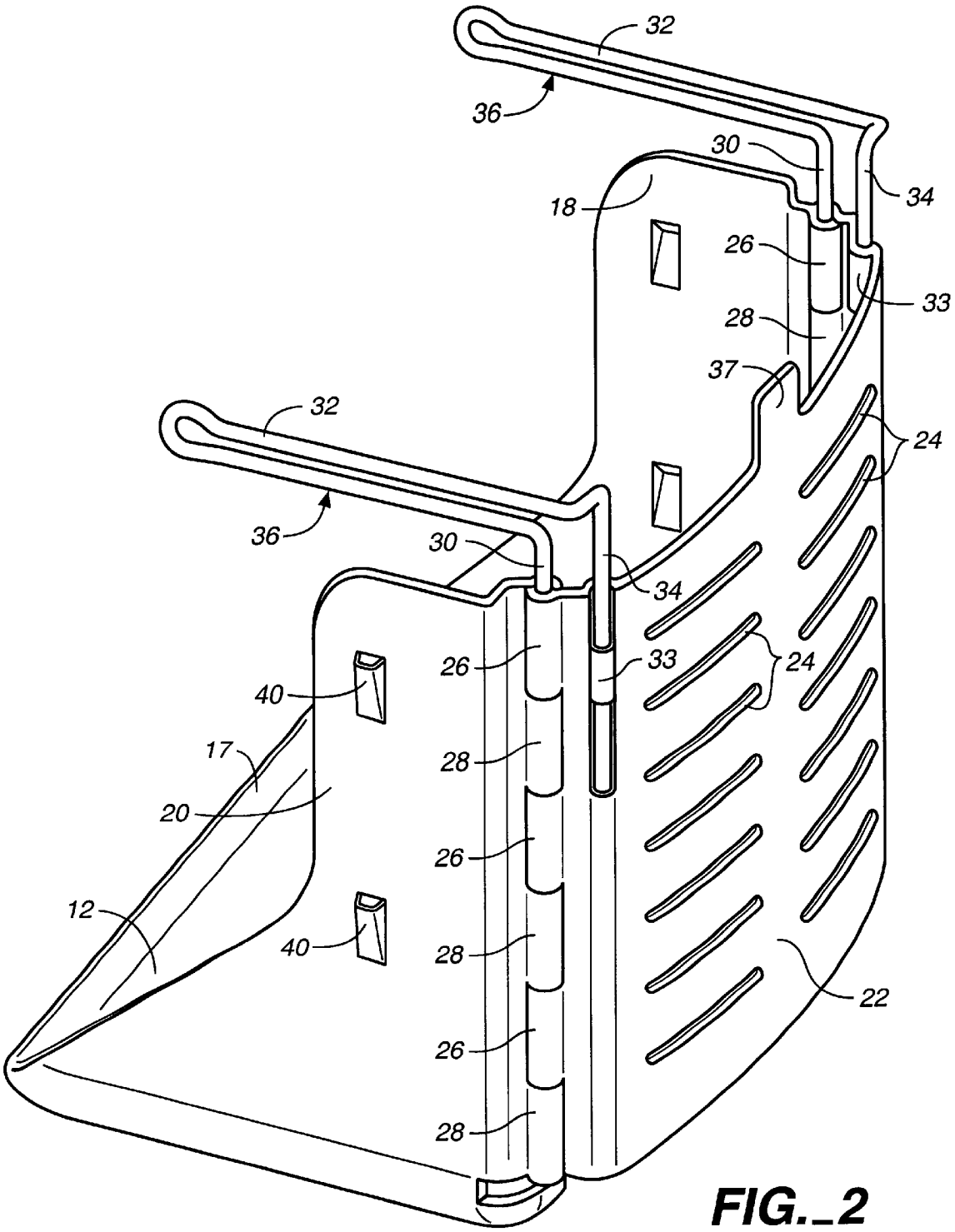
FIG. 2. is a pictorial view of the back side of the bag rack of FIG. 1.

As shown in FIGS. 1 and 2, both side walls 18, 20 and back wall 22 include hinge-like connector elements 26, 28 that, when joined and aligned with each other at the rear corners of the bag rack, provide for the reception of the forward upright legs 30 of a pair of L-shaped bag support arms 32. Upright legs 30 alternately extend through cylindrical elements 26 of back wall 22 and cylindrical elements 28 of side walls 18, 20. Additionally, back wall 22 includes formed cylindrical slot elements 33 adjacent each rear corner for the reception of a second, rear upright leg 34 of each bag support arm 32. The forward upright legs 30 of bag support arms 32 releasably join and secure side walls 18, 20 to back wall 22, while rear upright legs 34 provide added support for bag support arms 32.

Each bag support arm 32 includes an upper rod-formed section 36, which extends above base 12, cantilevered outwardly over the base, and in position for support of T-shirt bags in a distended condition over the base for filling of the bags. The rod-like extensions of upper sections 36 are sufficiently narrow to insert into holes in the looped handles of T-shirt bags and thereby support the bags for filling with items while held by bag rack 10.

Back wall 22 includes a center tab or hook 37 for receiving perforated tabs provided at the upper edge of each T-shirt bag. Hook 37 allows a multiplicity of bags to be mounted onto bag rack 10 in a manner where one bag at a time can be separated from the stack of bags supported by hook 37 and arms 32 and subsequently filled with items.

The side walls 18, 20 provide structural support to back wall 22 in order to maintain bag support arms 32 in position above base 12 as a bag is filled with items. Side walls 18, 20 are formed to allow access beneath the upper sections 36 of bag support arm 32 sufficient to grasp the looped handles of a suspended T-shirt bag in order to remove the bag. The particular design of side walls 18, 20 can vary from that shown, so long as the side walls extend between the base and the back wall and are designed to support the back wall in a manner that maintains the bag support arms in position above the base for receipt and support of T-shirt bags.

Side walls 18, 20, together with the base 12 and back wall 22, define a somewhat confined space or defined area for receiving a bag filled with items. The side walls function to limit formation of the base of the T-shirt bag beyond the edges of the base. In other words, the side walls limit the shape and size of the bag, as it is filled with items, to the size of the base and thereby support items loaded within the bags in a manner that promotes efficient full loading of the bags.

When mounted to side walls 18, 20, back wall 22 defines a wide slot-like opening 42 adjacent the base for receiving the bottom edges of the plurality of T-shirt bags supported on the bag support arms and held by hook 37. Opening 42 allows the bottom edges of stacked bags to be positioned out of the way so as not to interfere with upwardly turned back edge 16 and bag loading.

Side walls 18, 20 include additional formed supports 40 for mounting additional items to bag rack 10, such as bag handle dispensers of the type disclosed in my co-pending patent application entitled "Dispenser For Dispensing Bag Holders," Ser. No. 08/642,355, filed May 3, 1997. Supports 40 can also accommodate holding devices for smaller plastic bags, such as frozen food and ice cream bags as well as point of sale advertising placards.

Figure 3:
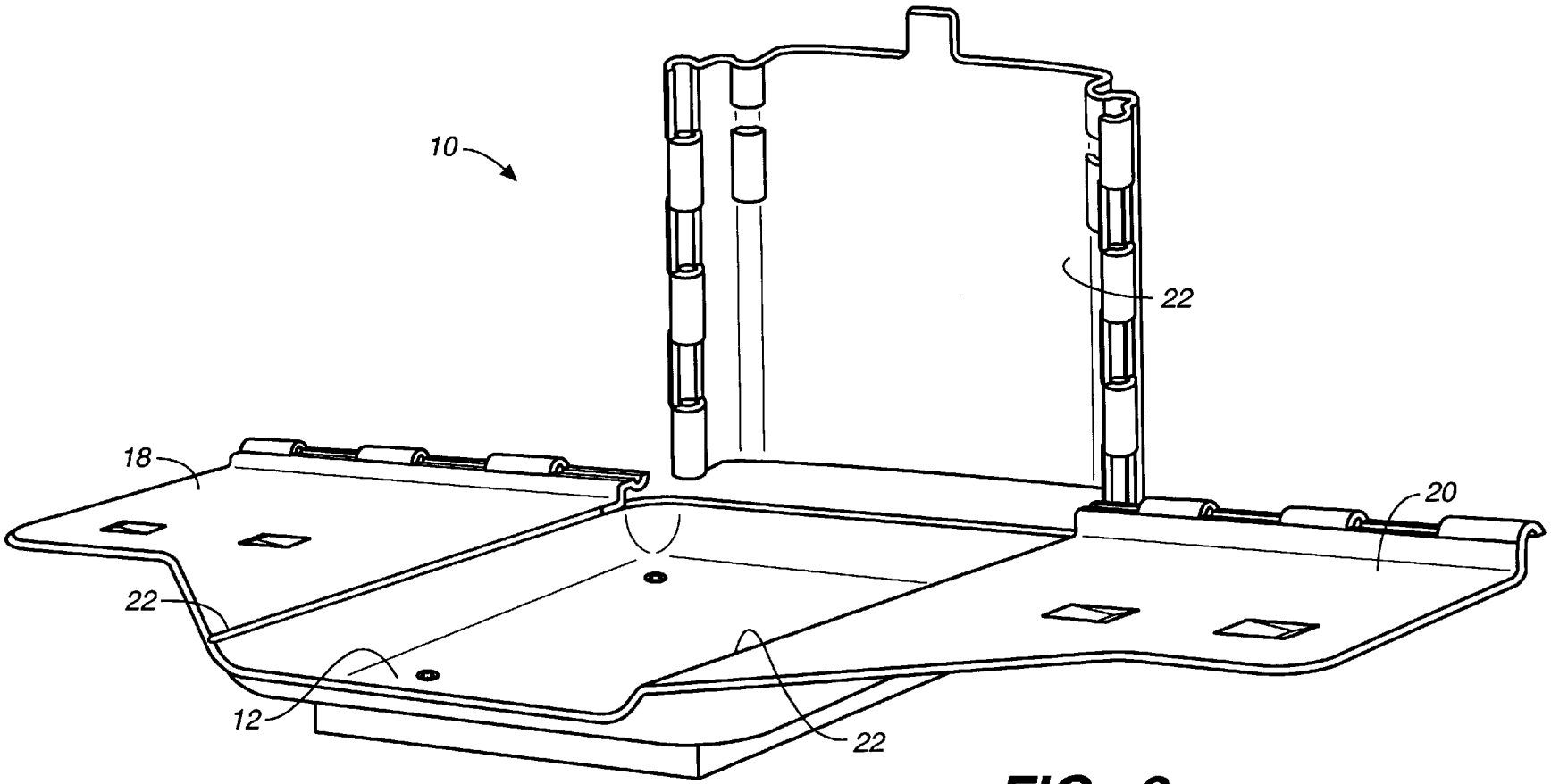
FIG. 3 is a disassembled pictorial view of the bag rack of FIG. 1 with the side walls thereof in a folded down position.
Figure 4:
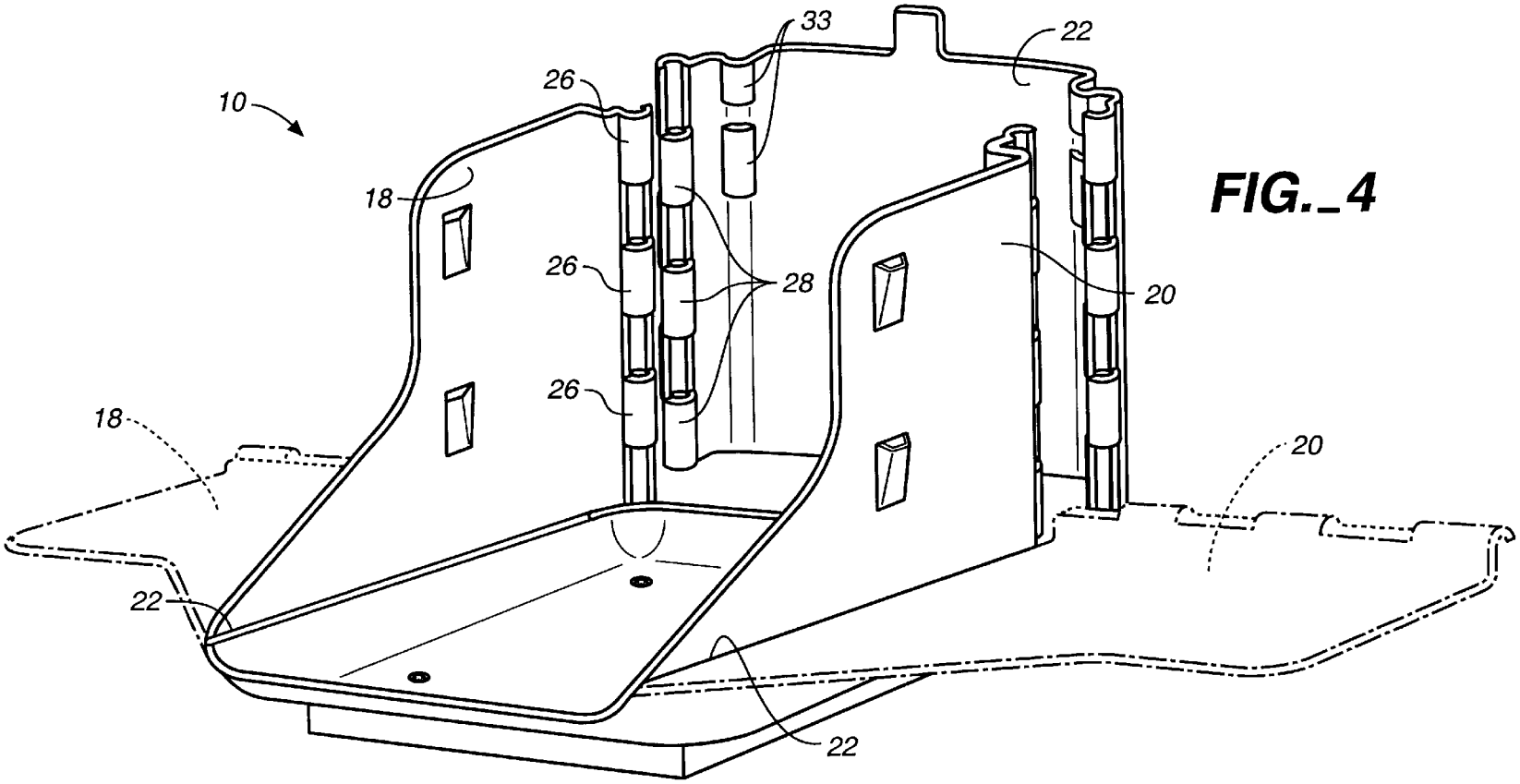
FIG. 4 is a pictorial view like FIG. 3 with the side walls folded upwardly.

Referring to FIG. 3, bag rack 10 is shown in a disassembled condition, with the bag support arms not shown and with side walls 18, 20 in a folded down position so that the base 12 and side walls 18, 20 are in a substantially flat configuration. As shown in FIG. 4, side walls 18, 20 can be folded upwardly to align with back wall 22 with hinge elements 26,28 aligned for the receipt of an upright leg of the bag support arms.

As shown in FIG. 5, in their folded down, flat configuration, side walls 18, 20 and base 12 can be stacked in an efficient configuration for shipment to retail markets. In addition, back walls 22 also can be stacked separately for a similar efficient packaging.

Figure 6:
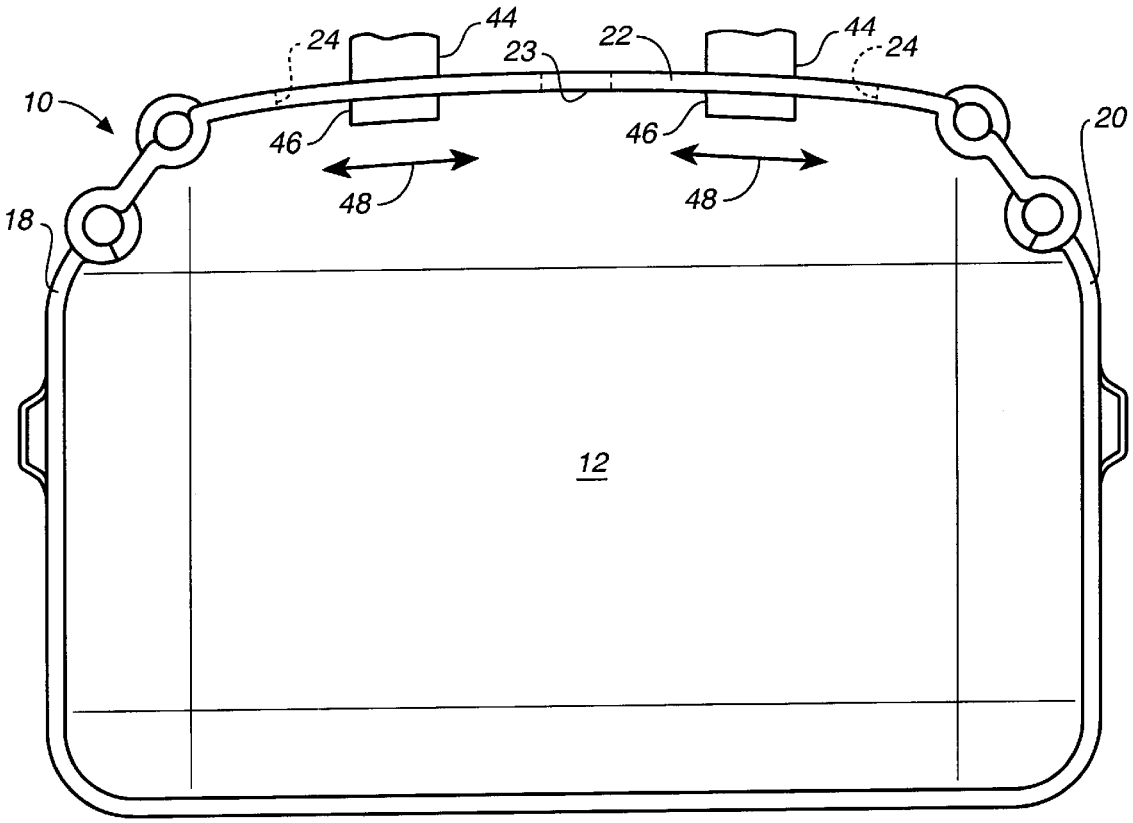
FIG. 6 is a plan view of the bag rack of FIG. 1 shown mounted on a pair of bag rack supports.

FIG. 6 shows a plan view of bag rack 10 mounted on a pair of bag rack mounts 44, which are mounted to a fixed part of a check out counter. Bag rack mounts 44 include upwardly turned front edges 46, which extend through slots 24 of back wall 22 and are upwardly turned so that they press against the inside surface of back wall 22 and thereby retain the bag rack on the mounts. Back wall 22 is arc-shaped, as represented by arc 23. Slots 24 in the arc-shaped portion of back wall 22 allow for repositioning of bag rack 10 relative to bag rack mounts 44 so that the alignment of the bag rack with a person loading items into bags held by the bag rack can be optimized in an ergonomic sense. Arrows 48 represent the adjustable directions for repositioning of bag rack 10.

Figure 7:
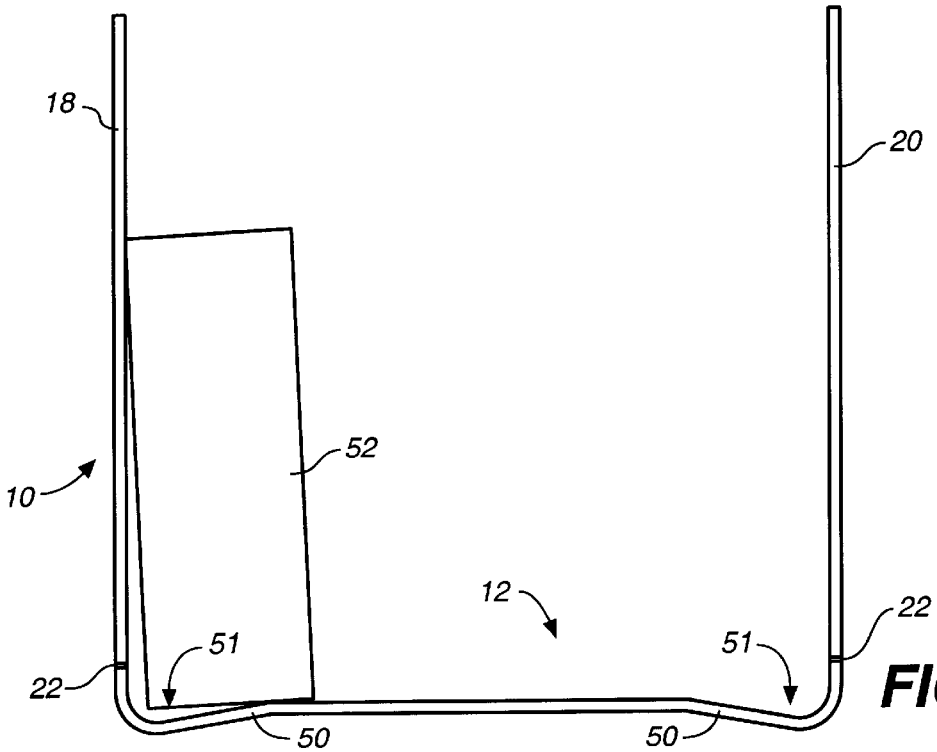
FIG. 7 is a cross-sectional view of an alternative embodiment of a bag rack of FIG. 1 with a trough formed around the perimeter of the base, shown with the side walls folded upwardly.

FIG. 7 shows a cross-sectional view of an alternative embodiment of a bag rack of FIGS. 1–6 with the side walls folded upwardly. The perimeter of base 12 is formed with a downward slope 50 from adjacent the center of the base to the side walls 18, 20 and back wall 22. Slope 50 forms a trough 51 around the perimeter of base 12. The downward slope of the base tilts an item 52 placed at the perimeter of the base outwardly, against the side walls and back wall. This holds the items in place and prevents them from falling over into the bag as subsequent items are placed into the center of the bag.

Another embodiment of the bag rack of the present invention has a back wall extending upwardly from the base, with the base and the back wall joined and monolithically formed from a plastic material. In this embodiment, side walls are provided, but they may or may not be monolithically formed with the base or back wall. In either case, the side walls function to provide both containment of items and structural support to the back wall in order to maintain the bag support arms in position above the base as a bag is filled with items.

In both embodiments of the present invention, it is important that the base, the back wall, and the side walls be sufficiently imperforate to prevent displacement of the T-shirt bags outwardly of the planes of the base, the back wall and the side walls during filling. In this manner, the base, back wall and side walls provide containment of the bag as it is being filled.

Figure 8:
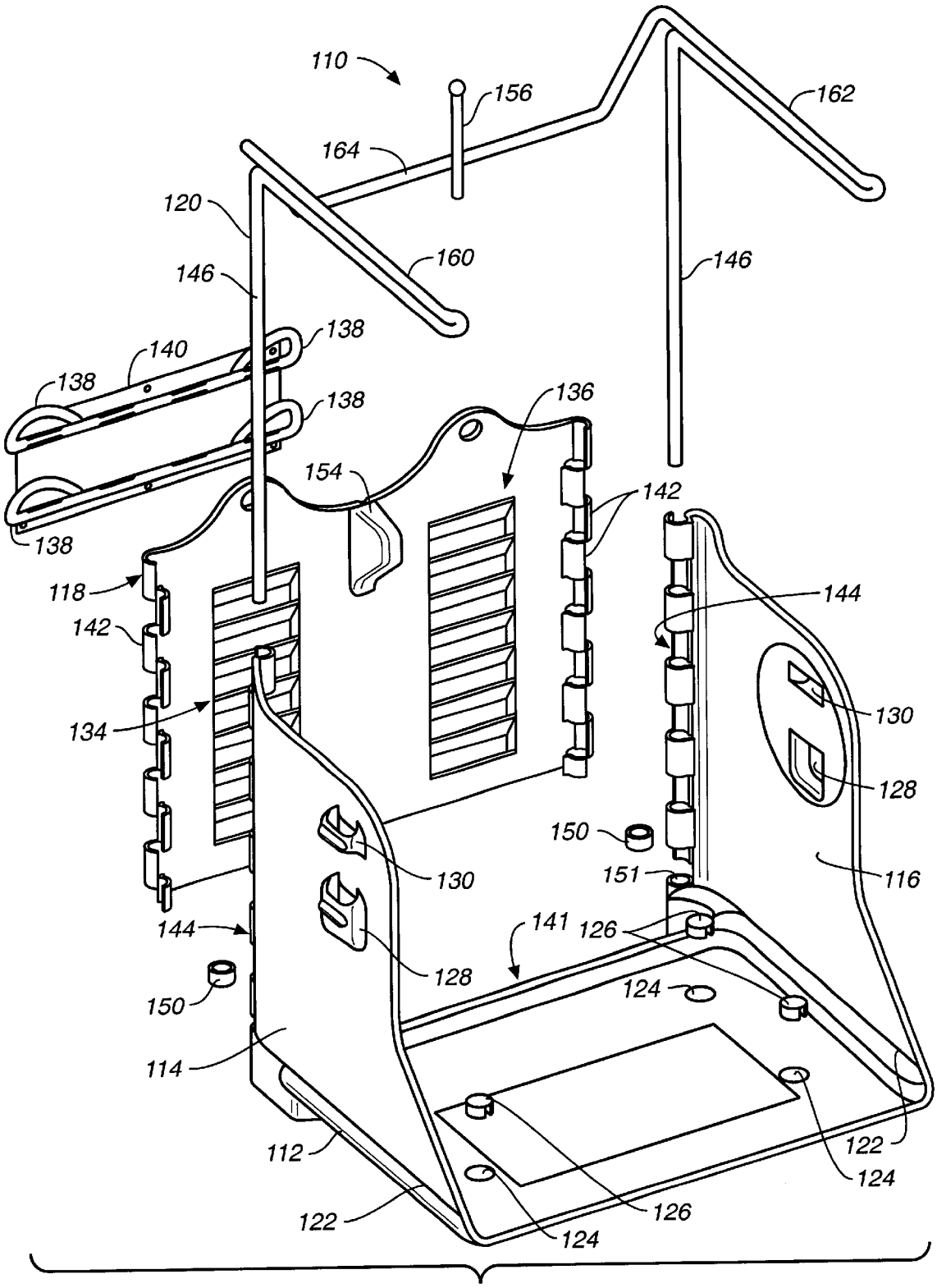
FIG. 8 is an exploded pictorial view of a second embodiment of a T-shirt bag rack dispenser of the present invention.

FIGS. 8–12 illustrate a second embodiment of the bag rack dispenser of the present invention. In FIG. 8, bag rack and dispenser 110 is essentially a three-piece assembly that includes a base 112 formed monolithically with a pair a side walls 114, 116, a back wall 118 formed separate from base 112 and side walls 114, 116, and a wire rod bag support arm assembly 120.

Base 112 and side walls 114, 116 are made by an injection molded plastic process as a single component piece with thin wall hinges 122 that allow side walls 114, 116 to pivot outwardly and down into a flat configuration so that the base and side walls can be stacked in an efficient arrangement. This feature is common to the first bag rack embodiment shown in FIGS. 1–5.

Base 112 includes a set of four countersunk screw recesses 124, which allow for mounting of bag rack 110 upright on a horizontal surface, such as a check-out counter top, by screws (not shown). Screw cover caps 126 fill in the countersunk recesses 124 and thereby cover the screw heads.

Side walls 114, 116 each include monolithically molded mounts 128, 130 for securing various attachments to the bag rack. One example of an attachment that a store may wish to include as part of the bag rack assembly is a Handle Helper® bag handle dispenser of the type disclosed in U.S. Pattern application Ser. No. 08/642,355, filed May 3, 1996, which is incorporated herein as part of the disclosure of the present invention. Another type of attachment that can mount to the bag rack 110 is a single post side bag holder of the type typically used for bagging frozen and refrigerated items, or a twin post side bag holder, which can support both a bag holder dispenser and a set of side bags. FIGS. 19–27, discussed later, show different types of attachments for use with bag rack 110.

Bag rack back wall 118 includes an array of horizontal slots 134, 136, which provide thru-openings in the back wall for receiving upwardly turned wire rod clips 138 of a mounting cleat 140 for the bag rack. Cleat 140 is designed to be secured to a vertical surface or frame member in order to mount bag rack and dispenser 110 in a suspended configuration at or below the surface of a counter. Slots 134, 136 in back wall 118 can be selectively used to secure to cleat 140 at one of several vertical spaced locations in order to adjust the position of the bag rack relative to a check-out counter and relative to check-out personnel using the device. In addition, back wall can be angularly adjusted relative to cleat 140 by sliding the back wall laterally, with clips 138 sliding within slots 134, 136. Angular adjustment optimizes the orientation of the bag rack dispenser 110 relative to the user, which facilitates both ease of packing items into the bag as well as proper positioning and location of the items inside the bag.

Base 112 includes a rear recessed area 141 that creates a relatively wide slot 172 (FIG. 10) extending the width of the back wall for receiving the lower ends of a set of T-shirt bags to be dispensed. The lower ends are splayed back from base 112 through slot 172 and do not interfere with loading and removal of the front-most opened bag that is being loaded with items.

Back wall 118 also includes a set of hinge-like connector elements 142 at each side, which mate with corresponding hinge-like connector elements 144 at the back side edges of side walls 114, 116. Back wall 118 is joined with side walls 114, 116 by meshing the hinge elements 142, 144 and inserting the downwardly depending legs 146 of wire rod bag support arm assembly 120 between the hinge elements, which prevents separation of the back wall from the side wall.

As discussed in more detail later, bag support arm assembly 120 can be vertically adjusted into one of two positions in order to accommodate different size T-shirt bags. For this, a height spacer 150 is provided for support of the end of each leg 146 of bag support arm assembly 120. Height spacers 150 mount at the base of the lowest hinge element at the back of side walls 114, 116 and effectively prevent legs 146 from extending down to the base of the rack when the arms are in their raised position. Height spacers 150 include a bottom plug (not shown) that sits in a recess 151 of base 112 and thereby rigidly interlocks the legs 146 to the base 112.

Back wall 118 also includes a monolithically molded forward protuberance 154 that functions as a backing to assist a user to grab or pinch the front bag in a stack of bags supported by a center post 156 positioned at the rear of protuberance 154. Center post 156 is used to hold a full set of stacked T-shirt bags to be dispensed one at a time on bag rack support 120. Each T-shirt bag conventionally includes a punched back center tab that, when the bags are stacked, creates aligned holes through which center post 156 can be inserted and used to mount a set of bags.

Bag support arm assembly 120 includes a pair of spaced-apart, forwardly extending bag support arms 160, 162, which each are cantilevered outwardly over base 112 in a manner to support a T-shirt bag in a distended condition over the base for filling of the bag. The loops of each T-shirt bag also conventionally include punched holes through which the bag support arms 160, 162 insert when the bags are mounted on the bag rack.

Bag support arm assembly 120 also includes a rear cross bar extension 164, which extends between bag support arms 160, 162 and extends downwardly behind back wall 118, as is discussed in more detail with reference to FIG. 9.

Figure 9:
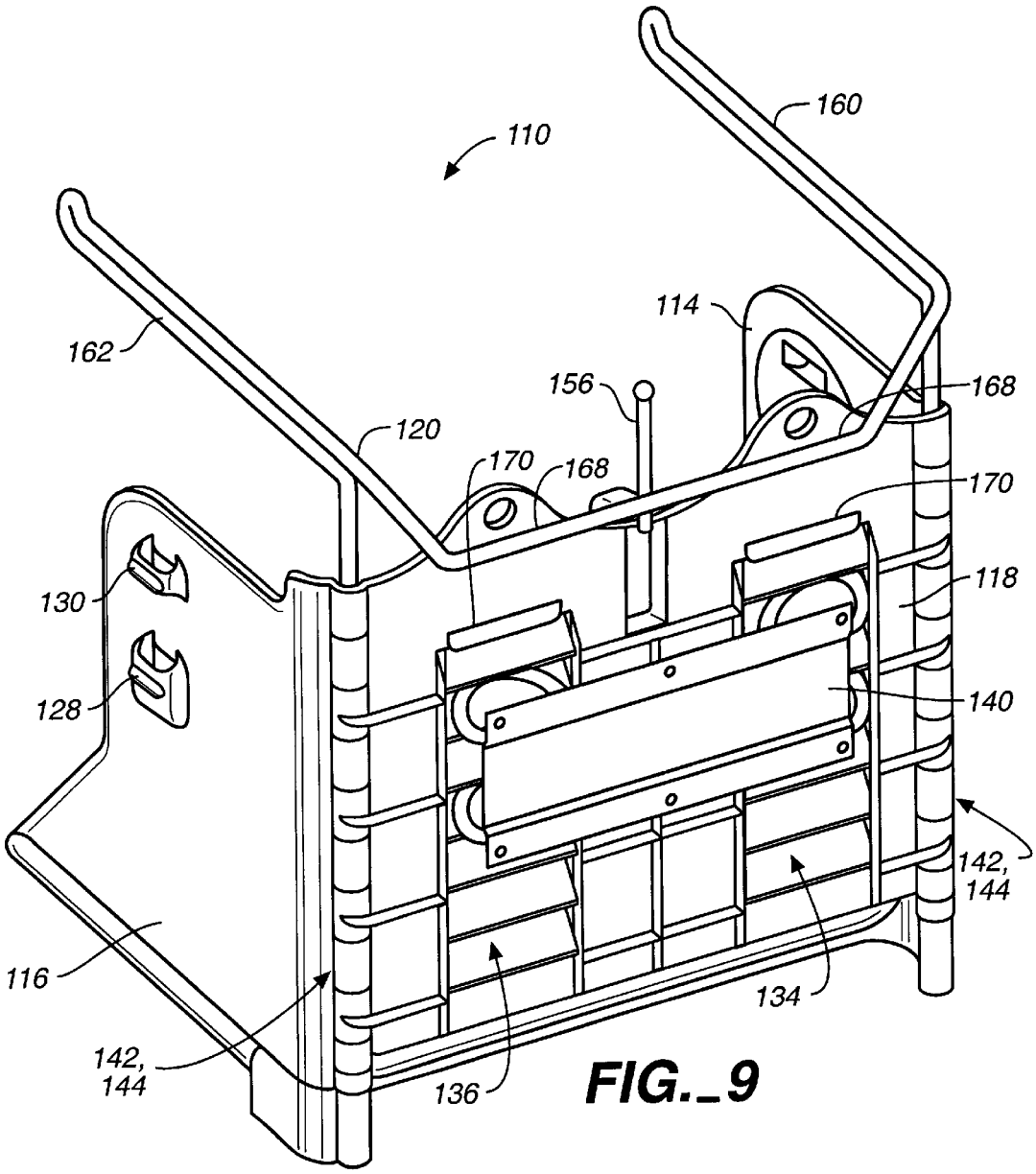
FIG. 9 is a rear pictorial view of the bag rack dispenser of FIG. 8 in a fully assembled configuration.
Figure 10:
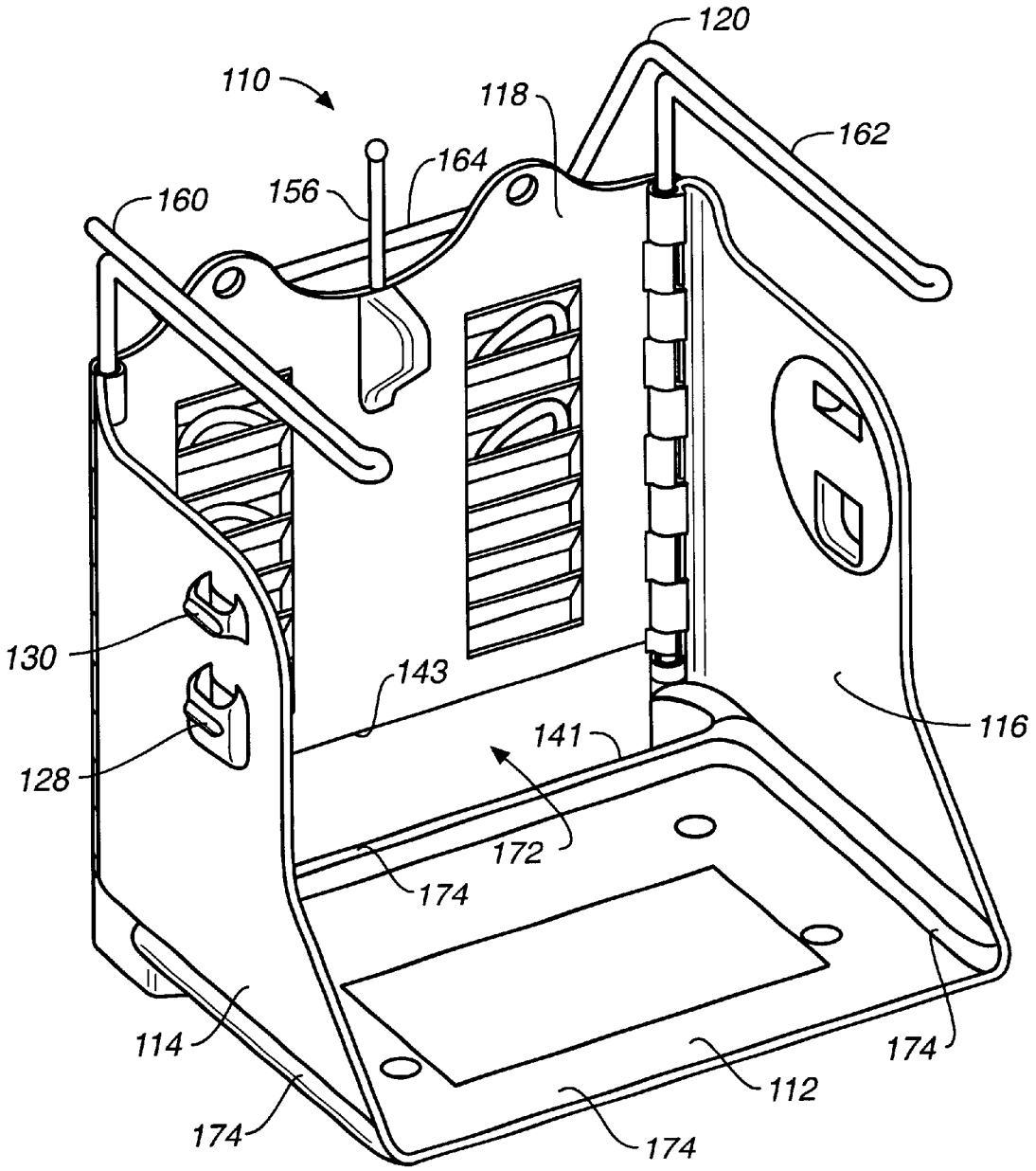
FIG. 10 is a front pictorial view of the bag rack dispenser of FIG. 9.

Referring to FIGS. 9 and 10, back wall 118 includes an extension engaging structure which is most preferably provided by an upper pair of channels 168 and a lower pair of channels 170 that are monolithically molded with the back wall and are C-shaped in cross section and oriented open to the rear of the back wall. Each channel 168, 170 forms a channel or receptacle for receiving a portion of transversely extending rear cross bar extension portion 164 of arm assembly 120 where the rear cross bar extends behind back wall 118. Cross bar arm extension 164 is held within the channels 168, 170 by closely dimensioned tolerances between the channels and the cross arms, which create a snap-fit mounting that is secure enough that it generally requires a lever or similar tool to remove the cross arm from the channel. The tight, snap-fitting action of the cross arm and the channels prevents bag packers and check-out personnel from tinkering with the set-up of the bag rack once properly configured for a particular application.

Additionally, the cooperative engagement of rear extension 164 and channels 168, 170 advantageously is highly effective in transferring the cantilever loading of arms 160, 162 to back 118, thus reducing stress on the hinges between the back and sides of the rack.

FIG. 10 shows an assembled front view of the bag rack 110. When assembled, recess 141 of base 112 defines with lower edge 143 of back wall 118 a laterally extending slot 172, which receives the lower ends of a set of stacked bags mounted on center post 156. Slot 172 extends the width of bag rack and bag dispenser 110 and provides a sufficient opening to place the lower ends of the stacked bags off of base 112 and out of the way so as not to interfere with loading of the front-most expanded bag.

Base 112 includes upwardly turned side and back edges 174, which function to assist in preventing loaded items within the bags from falling off of the base 112. For example, bulk items loaded in separate plastic bags are commonly loaded into T-shirt bags first and they tend to spread as their bulk material flows to a limited extent. Upwardly turned side edges 174 resist the tendency of the bulk material to urge the bag out over an edge of the base.

Figure 12:
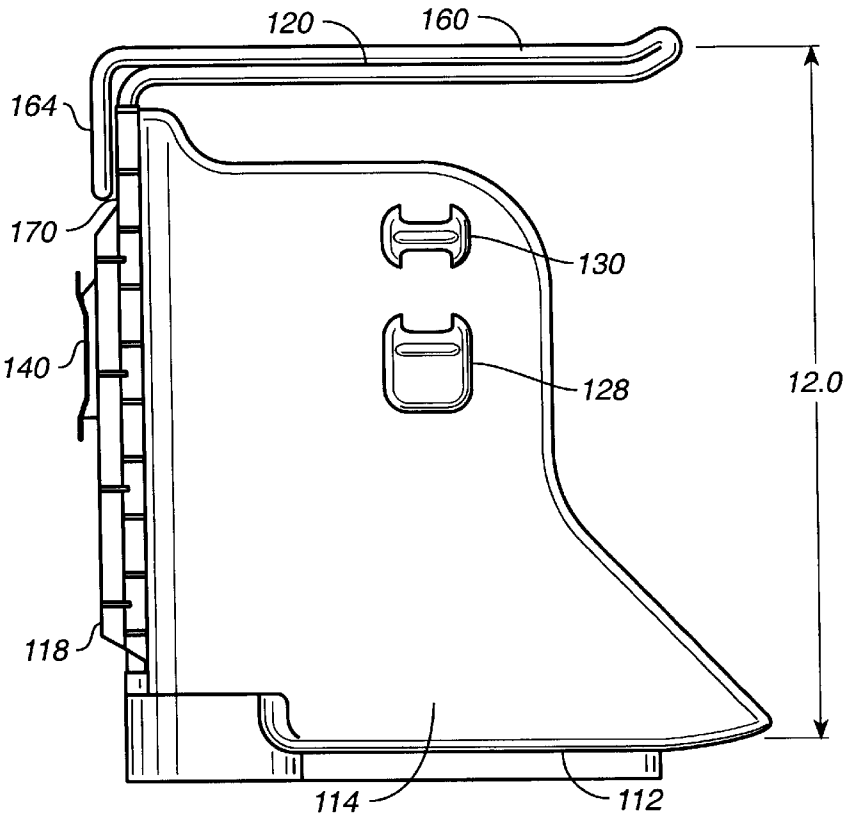
FIG. 12 is a side elevation view like FIG. 11 with the bag support arms in a lowered position.
Figure 11:
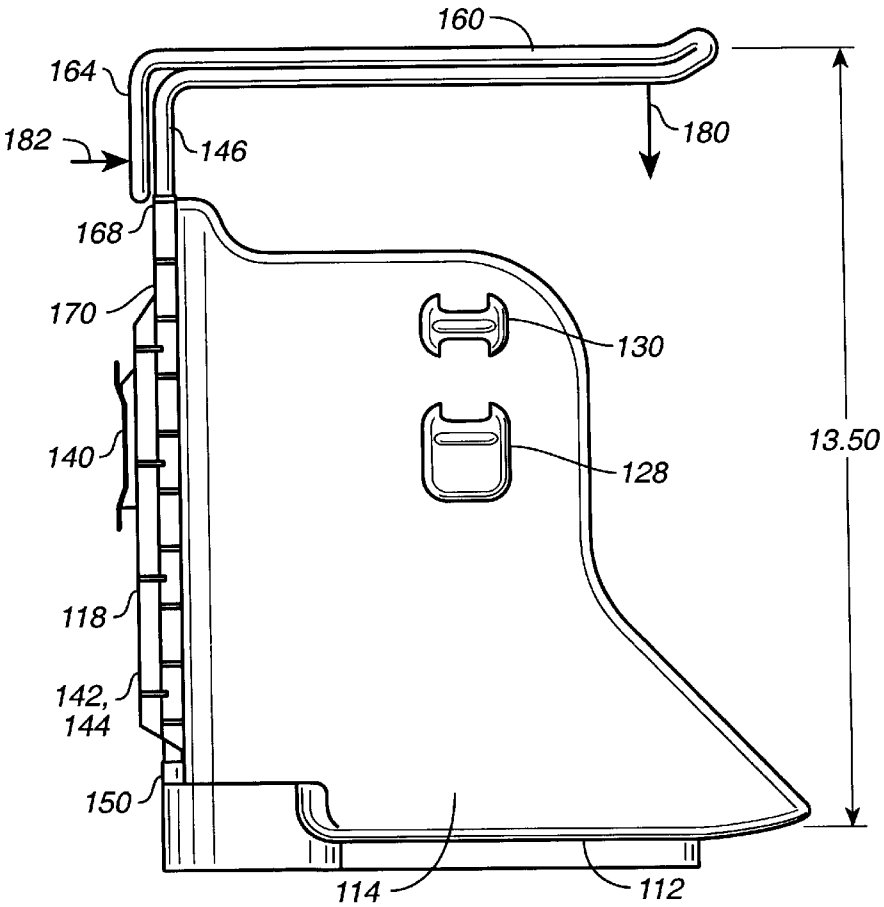
FIG. 11 is a side elevation view of the bag rack of FIGS. 9 and 10.

Referring to FIGS. 11 and 12, bag rack 110 is designed to allow bag support arm assembly 120 to be vertically adjusted into one of two positions. In FIG. 11, arm assembly 120 is in its upper, raised position, which preferably places bag support arms 160, 162 approximately 13.5 inches above base 112. In this position, rear cross bar extension 164 is positioned within upper channels 168.

To reposition the bag support arm assembly, bag support arms 160, 162 are pried from the channels 168 and height spacer 150 is removed. This allows the legs 146 of bag support arm assembly 120 to slide down to the base of the hinge elements 142, 144 and butt downwardly against the base. Then, rear cross bar extension 164 is repositioned into channels 170.

In FIG. 12, bag support arm assembly 120 is in its lower position, which preferably positions bag support arms 160, 162 approximately 12.0 inches above base 112. Heights of 13.5 inches and 12.0 inches accommodate the size of two conventional T-shirt style plastic bags commonly used by grocery stores, drug stores, and other types of convenience stores. In its lower position, bag support arm assembly 120 has its rear cross bar extension 164 positioned within lower channels 170.

Figure 13:
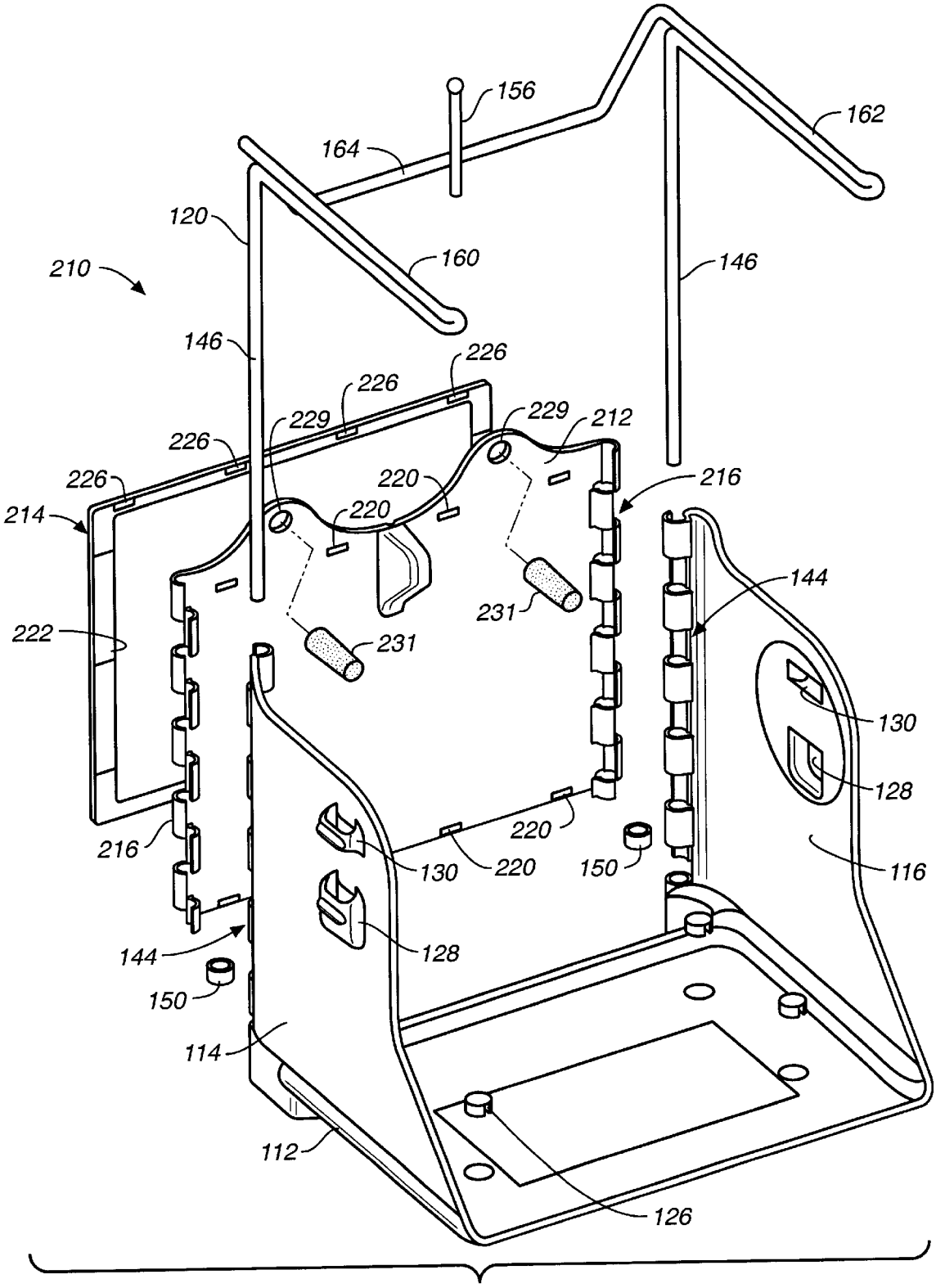
FIG. 13 is an exploded pictorial view of a modified version of the bag rack dispenser of FIGS. 8–12, with a display panel for advertising.
Figure 14:
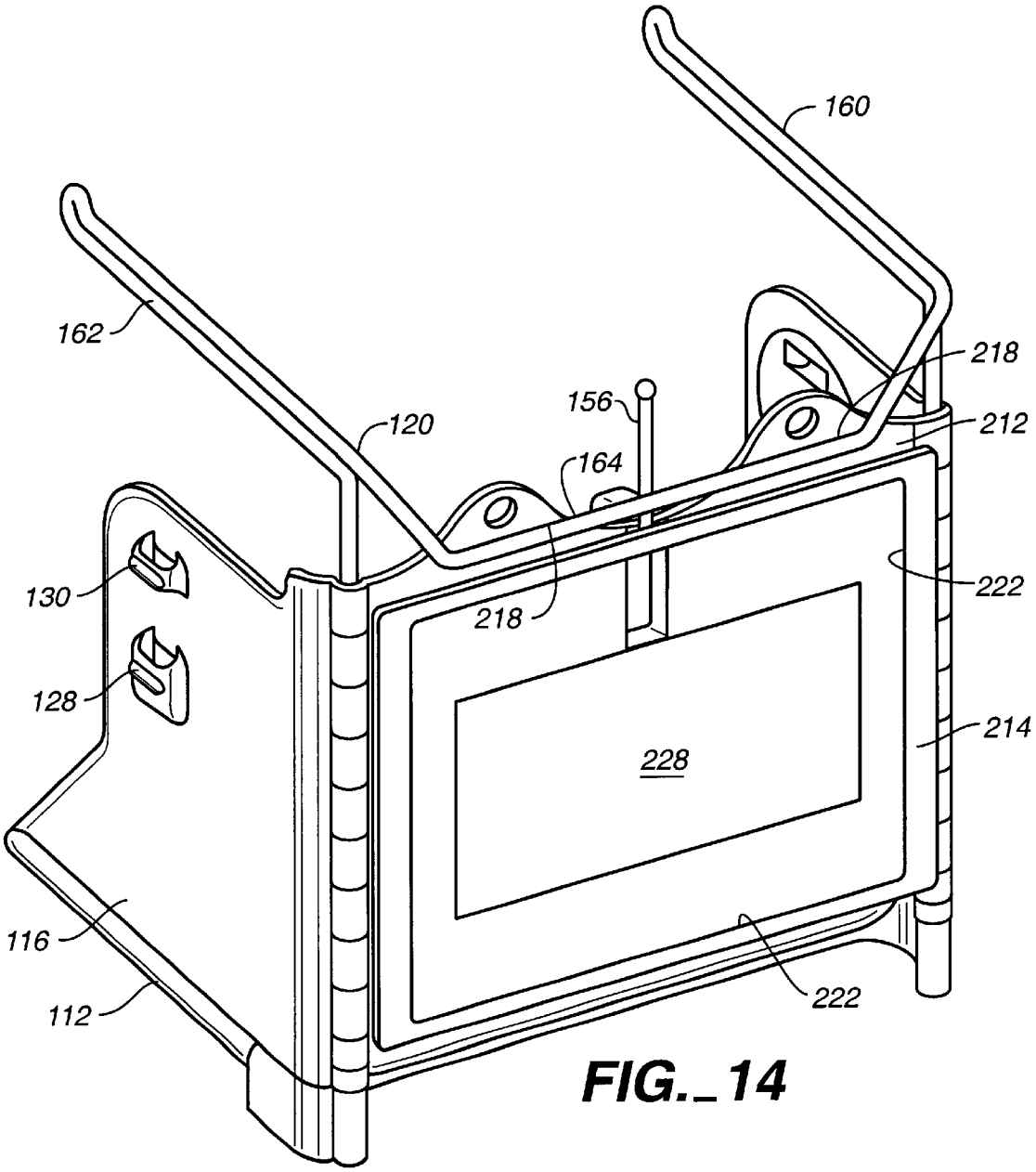
FIG. 14 is an assembled view of the modified bag rack dispenser of FIG. 13.

Referring to FIGS. 13 and 14, a modified bag rack 210 includes the same base 112 and side walls 114, 116 as the bag rack dispenser of FIGS. 8–12, but has a modified back wall 212 and transparent cover panel 214. Back wall 212 is flat in shape and includes hinge-like elements 216 at its side edges, which mesh with hinge elements 144 at the back edges of side walls 114, 116. However, back wall 212 only includes a single pair of channels 218. The second, lower pair of channels provided on the back wall of the rack and dispenser of FIGS. 8–12 is eliminated in order to provide space for advertising copy on the rear side of back wall 212. The pair of channels 218 that are provided function the same as the upper pair of channels on the prior embodiment. Back wall 218 also is provided with a series of short slots 220 along its upper and lower edges.

Transparent cover panel 214 includes a frame 222 and a transparent center panel 224. Frame 22 includes a series of tabs 226 around its periphery, which align with and insert into slots 220 of the back wall to secure the cover panel to the back wall. Advertising copy 228 can be inserted between cover panel 214 and back wall 212 and, as shown in FIG. 14, is noticeably displayed on the bag rack. Of course, this non-adjustable embodiment is primarily useful where the bag rack 210 is mounted in an upstanding position on a counter. For this reason, no adjustment mechanism is provided in back wall 212.

Back wall 212 includes a pair of circular openings 229 in upper raised portions of the back wall. Circular openings 229 are provided to allow a pair of cylindrical sponge segments 231 to be press-fitted to the back wall and thereby allow personnel to wet their fingers prior to grabbing and expanding the next T-shirt bag onto the bag support arms. Provision of sponges avoids sanitary problems associated with personnel licking their fingers in order to moisten them for gripping a bag.

Figure 15:
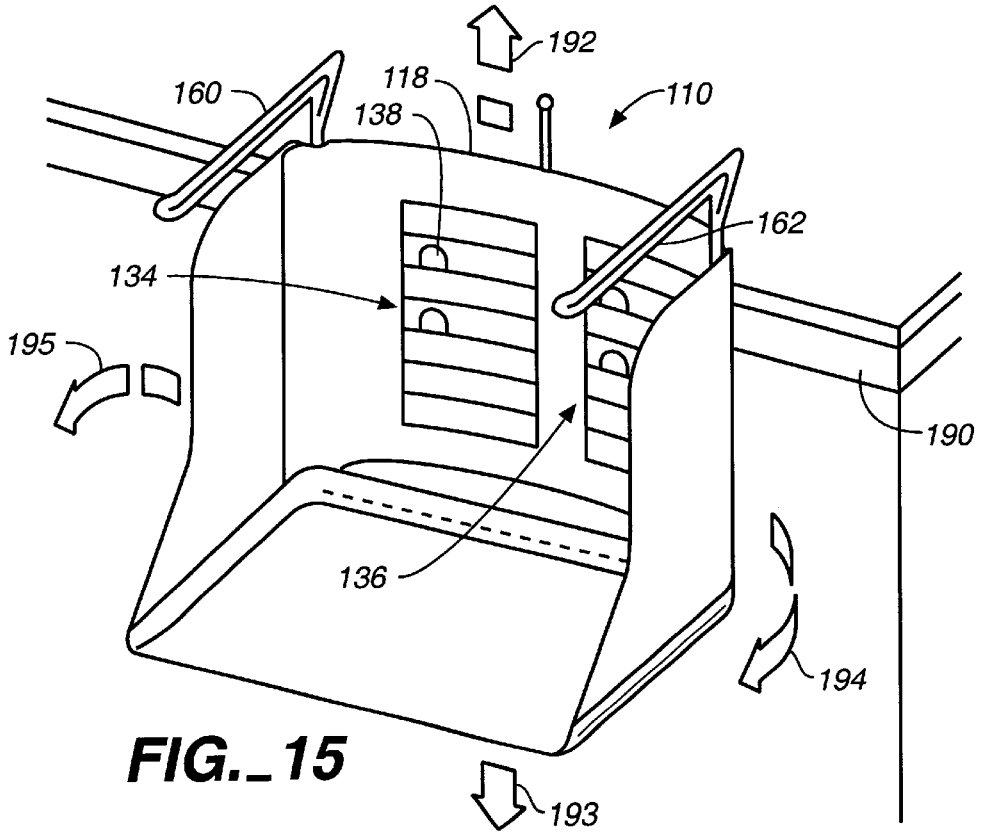
FIG. 15 is a schematic pictorial view of the bag rack dispenser of FIGS. 8–12 shown mounted at a check out counter.

The present invention also includes a method of loading items into T-shirt style bags in a manner that is easy and quick and which achieves maximum loading capacity of the bags. Referring to FIG. 15, the method includes the steps of adjusting a bag rack and dispenser 110 in position relative to a mounting structure such as a check-out counter 190 to orient and position bag rack 110 for optimum comfort and convenience of a bag packer. Slots 134, 136 allow for positioning of bag rack 110 in a variety of vertical positions, as shown by arrows 192, 193, and also allow for angular orientation by sliding arcuate back 118 of the bag rack about clips 138 of the mounting cleat, as indicated by arrows 194, 195. By properly positioning the bag rack, a bag packer can be more efficient in loading items in bags while at the same time utilizing the advantages of the bag rack to maximize the bag's loading capacity.

Figure 16:
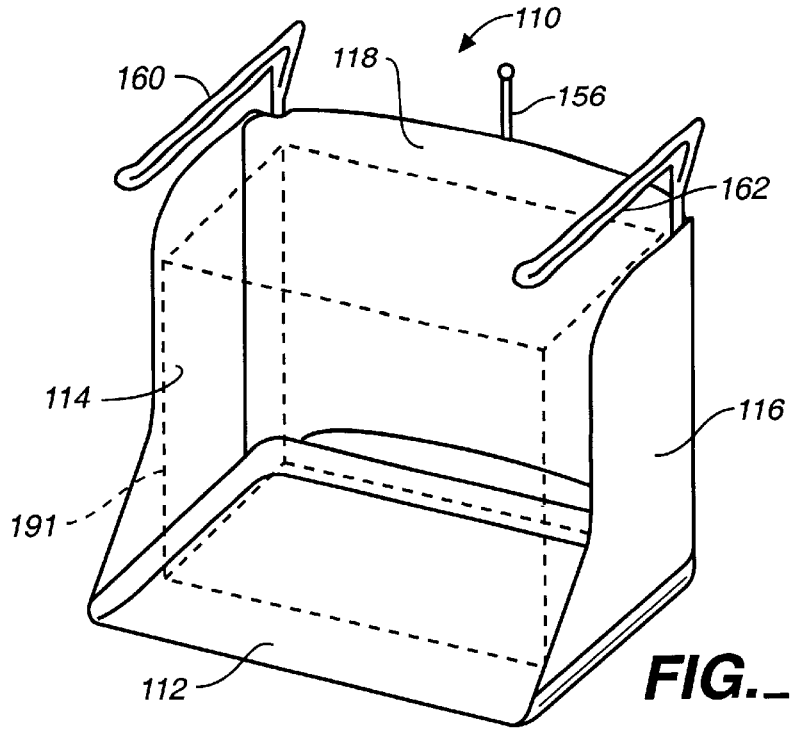
FIG. 16 is a schematic pictorial view of the bag rack of FIG. 15 with the bag packing volume defined by the bag rack shown in broken lines.

Referring to FIG. 16, the design and shape of side walls 114, 116, base 112, and back wall 118 provide and define a space 191 (shown in broken lines) for forming an expanded T-shirt bag in a manner where the side walls 114, 116 limit formation of the base and sides of the bag outwardly beyond the edges of the base 112. By limiting expansion or deformation of an expanded bag beyond the base edges, the natural, designed shape of the T-shirt bag is maintained, which provides an optimum volume for maximum loading capacity of the bag. Preferably, the method includes the step of supporting the sides of the bag with side walls of a bag rack that are substantially imperforate in order to better maintain the shape and form of the bag.

Many prior art bag racks include wire rod struts on the sides of the bag rack, which provide some structural support to the back of the bag rack, but which do little to assist in shaping the bag for efficient loading. Substantially imperforate side walls, such as side walls 114, 116 made by an injection molding process, provide the side support that is important in achieving greater bag load capacity.

Figure 17:
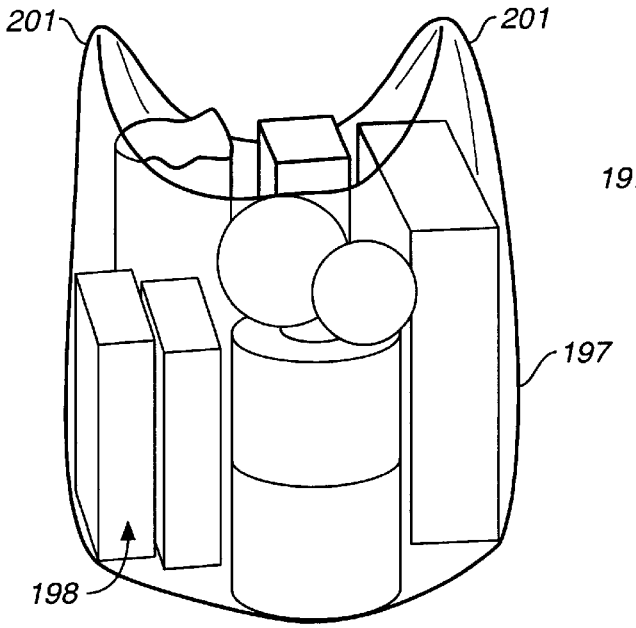
FIG. 17 is a schematic pictorial view of a T-shirt bag loaded with grocery items.

After a bag is loaded with items, it is removed from bag rack 110 by sliding the bag forwardly and removing the bag's loops 201 from the cantilevered arms 160, 162. The open front of bag rack 110 allows for easy removal of the bag, as well as easy expansion of the next bag in the stack of bags supported by center post 156. In FIG. 17, a T-shirt style bag 197 has been fully loaded with items 198 and removed from the bag rack dispenser of FIG. 16. During filling of items into bag 197, the side walls and back wall support the items, which is important to orderly arrangement of items in the bag and for maximum packing of the bag. Without sufficient side supports, items tend to fall over and rearrange themselves, resulting in inefficient packing.

After the bag is fully loaded with items, a Handle Helper® bag holder or handle 199 is secured to loops 201 of bag 197, which allows a customer to carry the bag in a comfortable manner and which keeps the loops substantially closed so that items do not fall out of the bag when the bag is set down in, for example, the trunk of a car. Utilizing a Handle Helper® bag holder in combination with the improved bag rack geometry of the present invention provides maximum usage of T-shirt style bags by first, allowing for more efficient, greater loading of the bags and second, ensuring that fully loaded bags are easy to handle and remain closed when set down. As a result, grocery stores should realize substantial savings in the number of bags used.

Figure 18:
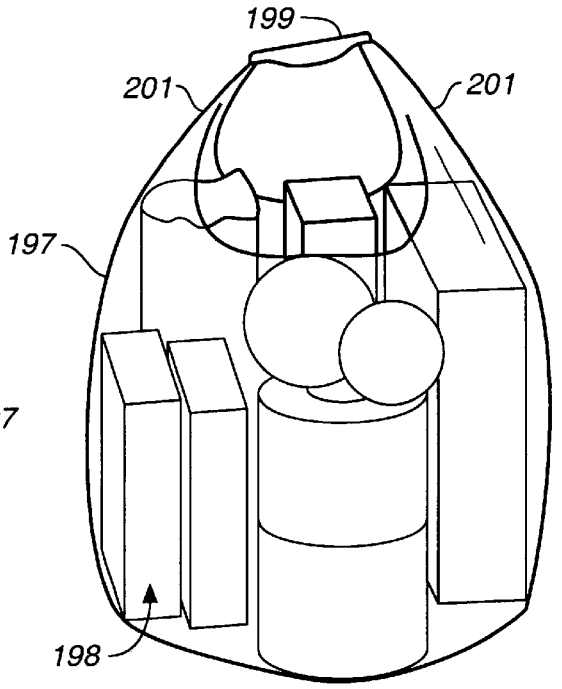
FIG. 18 is a schematic pictorial view of the loaded T-shirt bag of FIG. 17 with a bag carrying handle attached to the loops of the bag.
Figure 19:
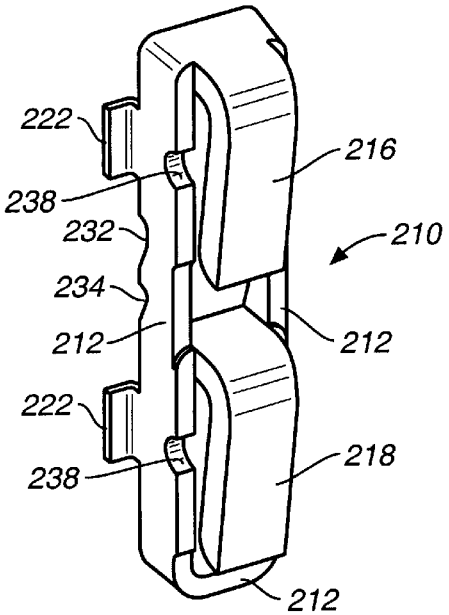
FIGS. 19 and 20 are a pictorial view and side elevation view respectively of a mounting clip for holding the dispenser plate of FIGS. 21 and 22 for bag carrying handles.
Figure 20:
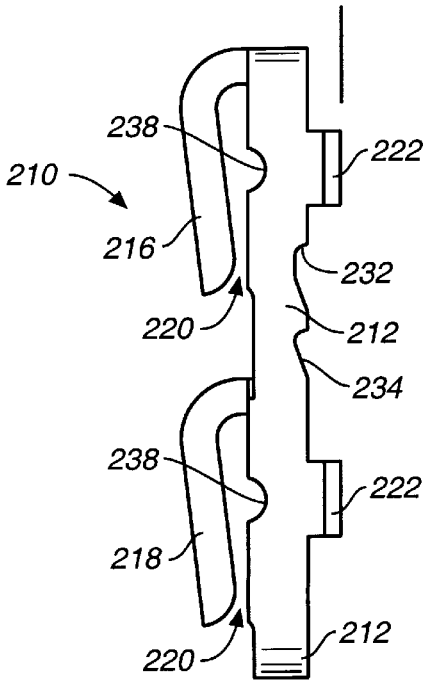

Referring to FIGS. 19–23, the different embodiments of the bag racks of the present invention discussed herein are compatible with several attachments for securing different accessories to the bag rack. In FIGS. 19 and 20, a mounting clip 210 is shown that attaches to a side wall of a bag rack and supports a dispensing plate 230 shown in FIGS. 21 and 22, which in turn carries a plurality of bag handles, such as handles 199 of FIG. 18. Mounting clip 210 includes an annular, rectangular side wall 212 with an upper clip 216 and lower clip 218 extending outwardly and downwardly from side wall 212. Clips 216, 218 are angled inwardly, as shown in FIG. 20, to create a narrow gap 220. Clips 216, 218 are outwardly flexible to increase gaps 220 in order to insert the clips into the pockets of the molded mounts 128, 130 of the bag rack of FIG. 8. Clips 216, 218 clip into the molded mounts 128, 130 to attach the mounting clip 210 to one of the side walls of the bag rack.

Mounting clip 210 includes four L-shaped support prongs 222 that extend outwardly from the back side of side wall 212. Support prongs 222 provide mounting supports for dispenser plate 230 shown and discussed with reference to FIGS. 21 and 22. The longer upright segments of side wall 212 each include a pair of V-shaped notches 232, 234 on their back edge. Notches 232 are discussed later. The front sides of side wall 212 include a pair of semi-circular notches 238, one behind each clip 216, 218. Each notch 238 receives the upper front edge of a molded mount 128, 130 in a ball-and-detent fashion to secure the mounting clip on the mount and to the side wall of the bag rack.

Figure 21:
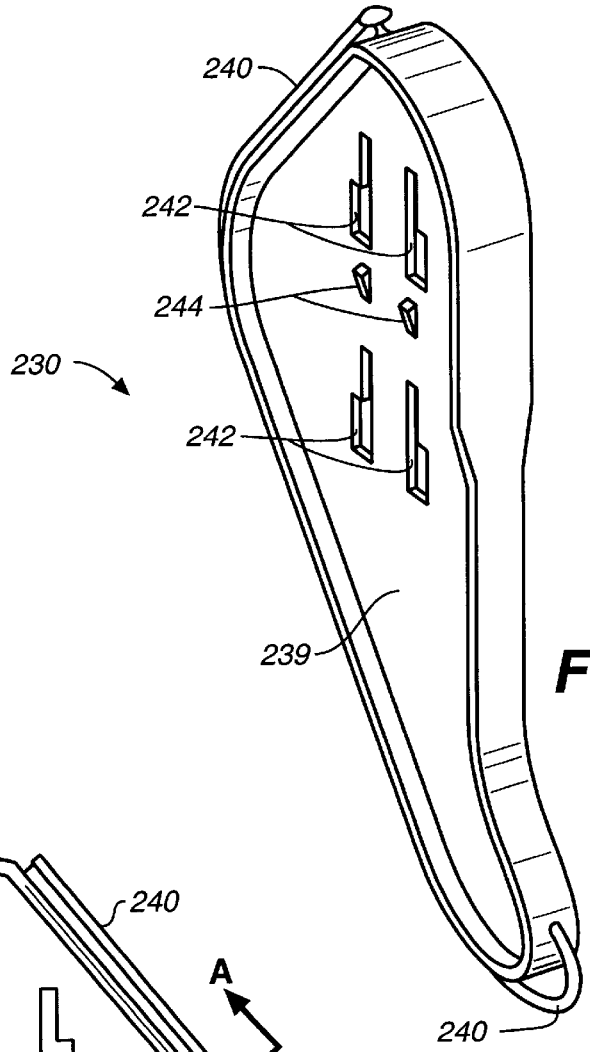
FIGS. 21 and 22 are a pictorial view and side elevation view respectively of a dispenser plate for dispensing bag carrying handles.
Figure 22:
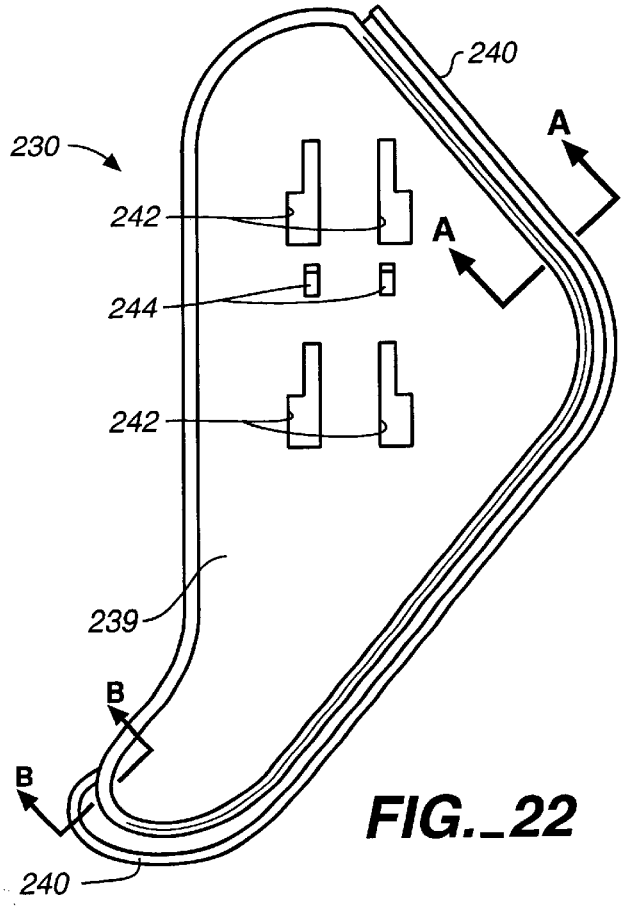

In FIGS. 21 and 22, dispensing plate 230 is similar in many respects to the dispenser of co-pending patent application Ser. No. 08/642,355, entitled "Dispenser for Dispensing Bag Holders." Dispensing plate 230 includes a somewhat triangular shaped back plate 239 that supports along one side a J-shaped guide rail 240, which carries a multiplicity of stacked bag holders of the type and in a manner described in U.S. Pat. Nos. 5,029,926 and 5,058,767. Back plate 239 includes four L-shaped slots 242 that allow for insertion of prongs 222 of mounting clips 210. The narrow upper portion of slots 242 prevent outward movement of dispenser plate 230 away from mounting clip 210, once the dispensing plate is properly secured to the mounting clip. A pair of raised bumps 244 are formed between slots 242 and are provided on both sides of back plate 239. The spacing between bumps 244 is equal to the width of mounting clip 210 so that when the dispensing plate is mounted onto the mounting clip, bumps 244 move into either one of the notches 232 in the side wall 212 of the mounting clip in a manner that presses together prongs 222 and the side edges of back plate 239 that form slots 242, thereby securely holding the dispensing plate to the mounting clip.

Figure 23:
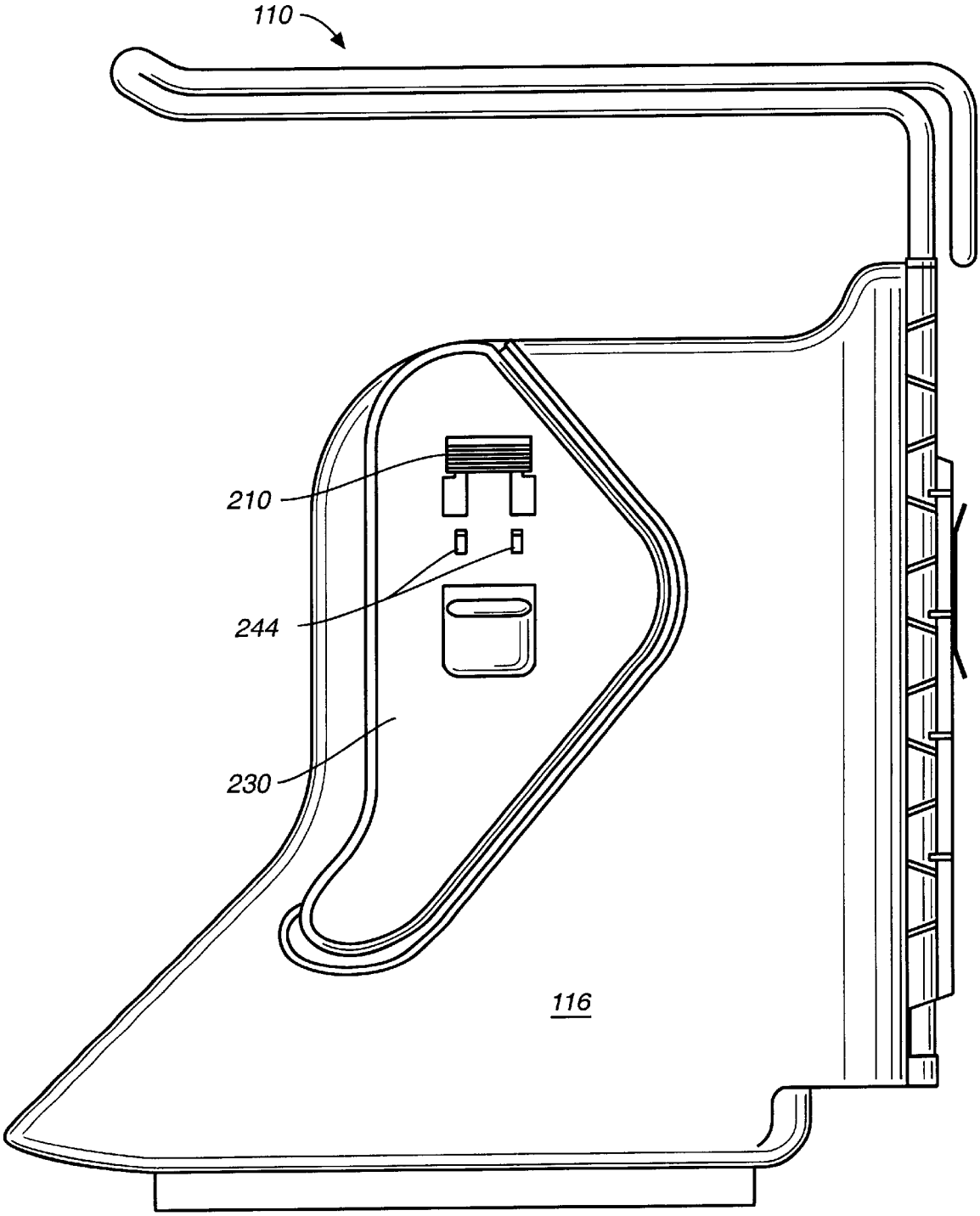
FIG. 23 is a side elevation view of the mounting clip and dispenser plate of FIGS. 19–22 mounted on a side of the bag rack of FIG. 8.

FIG. 23 shows mounting clip 210 and dispensing plate 230 attached to side wall 116 of bag rack 110 of FIG. 8. The dispensing plate and mounting clip can be secured to either side wall of the bag rack and can be quickly removed to replace the dispenser with a side bag holder, discussed later, or simply removed altogether.

Figure 24:
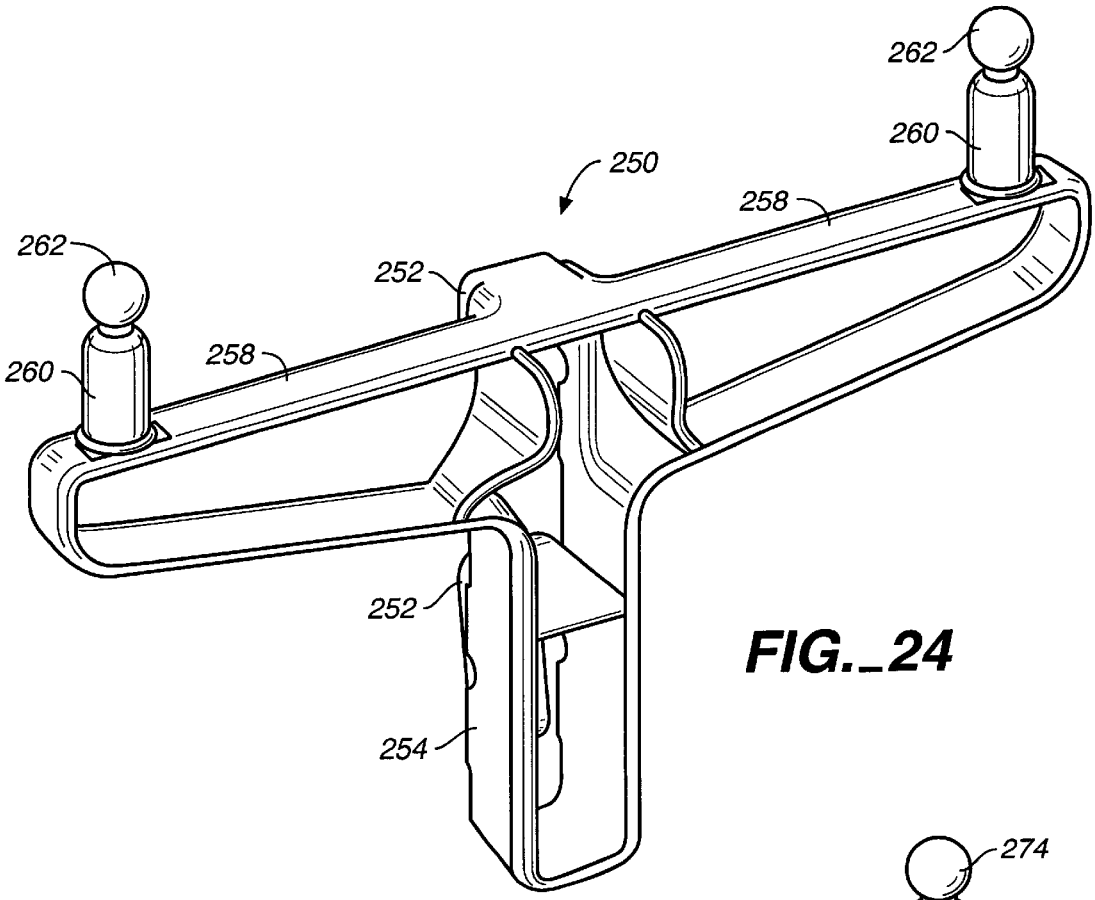
FIGS. 24 and 25 are a pictorial view and side elevation view respectively of a double post side bag hanger that attaches to the side of a bag rack.
Figure 25:
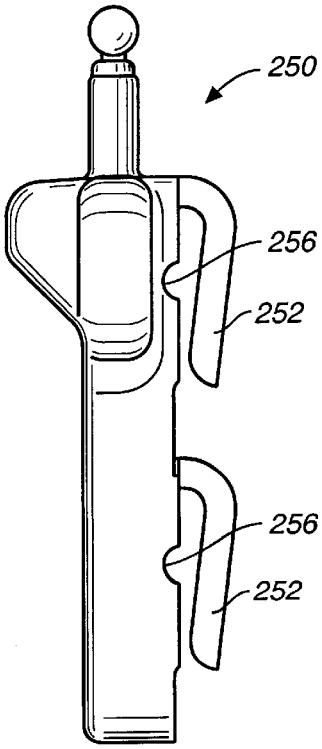

FIGS. 24 and 25 show a double post side bag holder 250 that is T-shaped and includes a pair of flexible clips 252 that are similar to the flexible clips of the mounting clip of FIGS. 19 and 20. Also, the upright trunk 254 of side bag holder 250 includes a set of notches 256 like the notches 238 of the same mounting clip. Accordingly, side bag holder 250 mounts onto the molded mounts 128, 130 of bag rack 110 in a manner similar to the mounting clip.

Figure 27:
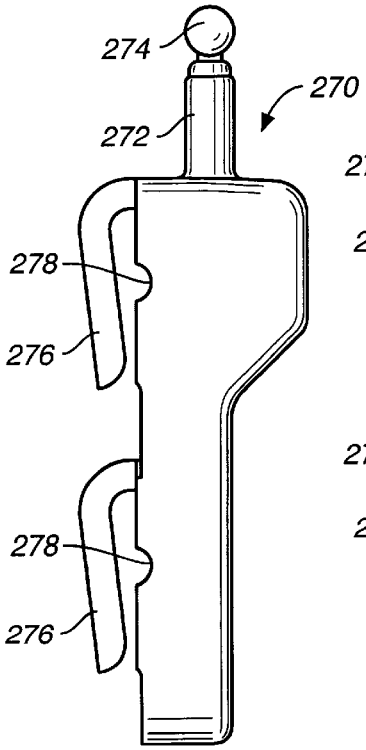
FIGS. 26 and 27 are a pictorial view and side elevation view respectively of a single center post side bag hanger.
Figure 26:
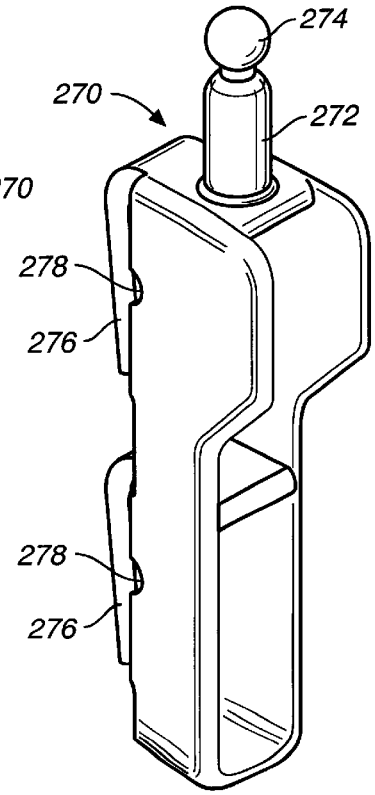

The outwardly extending arms 258 of side bag holder 250 each include an upright post 260 with a rounded head 262. The pair of posts 262 are spaced appropriately for receiving pre-punched holes in small side bags of the type typically used to bag items that need to be separately bagged, such as for example ice cream. Similarly, as shown in FIGS. 26 and 27, a single center post bag holder 270 has a single upright post 272 with a rounded head 274 for receiving a pre-punched hole of a side bag of the type with a single pre-punched hole for mounting. Single post bag holder 270 includes a pair of clips 276 and notches 278 like those of the double post side bag holder 250.

A principle advantage of the bag rack of the present invention is its flexibility to accommodate different size bags as well as different accessories through adjustment and modification of the various features of the bag rack. The bag rack dispenser can be raised and lowered to accommodate different size bags, side bag holders and additional bag stacks can be attached to either side of the bag rack, and different advertising displays can be mounted at the rear of the bag rack. And these features can be mixed and matched to suit a particular customers preferences. As a result of this flexibility, stores can significantly reduce the number of different types of bag racks they stock.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto when read and interpreted according to accepted legal principles such as the doctrine of equivalents and reversal of parts.

The invention claimed is:

1. A bag rack for support of plastic bags comprising:

a base;

a back wall extending upwardly from the base;

a pair of spaced-apart bag support arms each extending forwardly, cantilevered outwardly over the base to position the bag support arms for support of a bag in a distended condition over the base for filling of the bag;

a rear extension secured to the bag support arms and extending transversely behind the back wall, the back wall including an extension engaging structure formed for fastener-free cooperative engagement with the rear extension for releasably coupling of the rear extension to the back wall for transfer of downward forces on the forwardly extending bag support arms in a manner supporting cantilevered loads on the bag support arms from the back wall; and the rear extension being mounted in coupled engagement with the extension engaging structure.

2. The bag rack of claim 1 wherein, the extension engaging structure is provided by a channel opening in a rearwardly facing direction on the back wall, and a transversely extending portion of the rear extension is mounted in and cooperatively engaged by the channel.

3. The bag rack of claim 2 wherein, the rear extension is provided by a cross bar that extends between the pair of bag support arms and across the back side of the back wall, and the channel extends inwardly to a depth less than a thickness dimension of the back wall.

4. The bag rack of claim 1 wherein, the bag support arms are vertically adjustable, and further comprising at least a second extension engaging structure provided on the back wall at a position vertically displaced from the first named extension engaging structure, the second engaging structure being formed for fastener-free cooperative engagement with the rear extension bag support arms to be positioned in at least two vertical locations relative to the base, and the rear extension being coupled to one of the first named and the second extension engaging structure at a selected vertical location.

5. The bag rack of claim 4 wherein, the first and second extension engaging structures are provided by first and second pairs of C-shaped channels facing rearwardly on the back wall and formed to receive a transversely extending portion of the rear extension therein.

6. The bag rack of claim 1 wherein, the back wall includes an opening for securing a sponge to the bag rack.

7. The bag rack of claim 1 and further including, a forward protuberance on the back wall that assists in grabbing a front T-shirt bag from a stack of T-shirt bags.

8. A bag rack for support of plastic bags comprising:

a base;

a back wall extending upwardly from the base;

side walls extending between the base and the back wall;

a pair of spaced-apart bag support arms each extending forwardly, cantilevered outwardly over the base, to position the bag support arms for support of a bag in a distended condition over the base for filling of the bag, the bag support arms including downward extensions releasably joining the side walls to the back wall; and a rear extension secured to the bag support arms and extending behind the back wall, the back wall including an extension engaging structure coupling the rear extension to the back wall so that downward forces on the forwardly extending bag support arms are coupled to the back wall in a manner supporting cantilevered loads on the bag support arms.

9. The bag rack of claim 8 wherein, the side walls and back wall are formed for repositioning relative to the base in order to provide for efficient packaging of multiple bag racks.

10. The bag rack of claim 9 wherein, the side walls and back wall can be positioned generally in a plane substantially parallel to the base in order to create a substantially flat configuration.

11. The bag rack of claim 8 wherein, the base has edges, the side walls, together with the base and the back wall, define a space for receiving a T-shirt bag filled with items, the side walls being formed in a manner that limits formation of the base of the T-shirt bag beyond the edges of the base.

12. A bag rack for support of plastic bags comprising:

a base;

a back wall extending upwardly from the base;

a pair of spaced-apart bag support arms each extending forwardly, cantilevered outwardly over the base to position the bag support arms for support of a bag in a distended condition over the base for filling of the bag;

a rear extension cross bar secured to the bag support arms and extending behind the back wall, the back wall including a rearwardly facing channel formed to snap-fit together with the cross bar for coupling the bag support arm to the back wall so that downward forces on the forwardly extending bag support arms are coupled to the back wall in a manner supporting cantilevered loads on the bag support arms; and the cross bar being snap-fit into the channel.

* * * * *